US011193277B2

(12) United States Patent
Babcock

(10) Patent No.: US 11,193,277 B2
(45) Date of Patent: Dec. 7, 2021

(54) STRAND-TO-THREADBAR COUPLER BLOCK FOR PRESTRESSED CONCRETE

(71) Applicant: INSIDE BET LLC, Eden, UT (US)

(72) Inventor: John Babcock, Eden, UT (US)

(73) Assignee: Inside Bet LLC, Eden, UT (US)

( * ) Notice: Subject to any disclaimer, the term of this patent is extended or adjusted under 35 U.S.C. 154(b) by 0 days.

(21) Appl. No.: 17/187,402

(22) Filed: Feb. 26, 2021

(65) Prior Publication Data

US 2021/0277657 A1 Sep. 9, 2021

Related U.S. Application Data

(60) Provisional application No. 62/985,247, filed on Mar. 4, 2020.

(51) Int. Cl.
*E04C 5/12* (2006.01)

(52) U.S. Cl.
CPC ..... *E04C 5/125* (2013.01); *E04C 5/122* (2013.01)

(58) Field of Classification Search
CPC ..... E04C 5/125; E04C 5/122; E04B 1/4157
USPC ..... 52/23, 223.13
See application file for complete search history.

(56) References Cited

U.S. PATENT DOCUMENTS 3,049,775 A * 8/1962 Ondeck ..... E04C 5/122 403/365
3,936,256 A * 2/1976 Howlett ..... E04C 5/122 425/111
4,307,550 A * 12/1981 Behar ..... B28B 23/04 24/136 R
4,718,209 A * 1/1988 Hansen ..... E04C 5/122 52/223.13
4,899,499 A * 2/1990 Hoekstra ..... E01F 13/028 403/78
5,347,777 A * 9/1994 Sudduth ..... E04C 5/122 52/223.13
6,065,263 A * 5/2000 Taguchi ..... E04B 5/023 403/305
6,951,078 B2 * 10/2005 Espinosa ..... F16B 37/00 52/23
7,716,800 B1 * 5/2010 Percheron ..... E04C 5/122 29/413
8,051,615 B2 * 11/2011 Mathews ..... F16G 11/106 52/223.13
8,286,309 B2 * 10/2012 Landry ..... F16G 11/048 24/136 B (Continued)

*Primary Examiner* — Paola Agudelo
(74) *Attorney, Agent, or Firm* — Kunzler Bean & Adamson; Bruce R. Needham

(57) ABSTRACT

A system for a strand-to-threadbar coupler block for prestressed concrete is disclosed. A system includes a concrete member, one or more multi-wire strands disposed within the concrete member, and a strand-to-threadbar coupler block disposed within the concrete member. The strand-to-threadbar coupler block is formed with a threadbar opening to admit a threadbar, and with one or more strand openings. The system includes one or more strand chucks coupled to the strand-to-threadbar coupler block at the one or more strand openings. A chuck diameter for the one or more strand chucks is greater than a diameter for the one or more strand openings, and the one or more multi-wire strands extend through the one or more strand openings and engage the one or more strand chucks.

20 Claims, 17 Drawing Sheets

(56) References Cited

U.S. PATENT DOCUMENTS

| | | | | |
|---|---|---|---|---|
| 2001/0037611 | A1* | 11/2001 | Cornett, Sr. | E04B 7/02 52/23 |
| 2008/0302035 | A1* | 12/2008 | Shin | E02D 5/765 52/223.13 |
| 2009/0139177 | A1* | 6/2009 | Holdsworth | E04C 5/165 52/713 |
| 2012/0180423 | A1* | 7/2012 | Avila | E04H 9/021 52/700 |
| 2013/0067849 | A1* | 3/2013 | Espinosa | E04B 1/4121 52/699 |

* cited by examiner

STRAND-TO-THREADBAR COUPLER BLOCK FOR PRESTRESSED CONCRETE

CROSS-REFERENCES TO RELATED APPLICATIONS

This application claims the benefit of U.S. Provisional Patent Application No. 62/985,247 entitled "STRAND-TO-THREADBAR COUPLER BLOCK FOR PRESTRESSED CONCRETE" and filed on Mar. 4, 2020 for John Babcock, which is incorporated herein by reference.

FIELD

This invention relates to prestressed concrete and more particularly relates to a strand-to-threadbar coupler block for prestressed concrete.

BACKGROUND

Unreinforced concrete has high compressive strength but is weak under tension. Reinforced concrete includes internal members (such as rebar) with high tensile strength, so that compressive forces are resisted by the concrete and tensile forces are resisted by the internal members. However, elongation of the internal members under tension may still eventually cause internal tension in the concrete, potentially resulting in the concrete cracking, crumbling, separating, or otherwise losing strength. Thus, in prestressed concrete, internal members such as threadbar or multi-wire steel strand are tensioned to pre-compress the concrete, so that later-applied tensile forces first reduce the amount of internal compression in the concrete, rather than causing internal tension.

However, the effective prestress force (e.g., tension in the internal threadbar or strand, or the opposing internal compression of the concrete) may be less than the initial prestress force applied to the internal threadbar or strand, due to a variety of stressing losses, such as seating losses at anchorages, or relaxation of the prestressing steel. Threadbar may be less prone to prestress loss than multi-wire strand, but may also be several times more expensive than multi-wire strand.

SUMMARY

A system for a strand-to-threadbar coupler block for prestressed concrete is disclosed. A system includes a concrete member, one or more multi-wire strands disposed within the concrete member, and a strand-to-threadbar coupler block disposed within the concrete member. The strand-to-threadbar coupler block is formed with a threadbar opening to admit a threadbar, and with one or more strand openings. The system includes one or more strand chucks coupled to the strand-to-threadbar coupler block at the one or more strand openings. A chuck diameter for the one or more strand chucks is greater than a diameter for the one or more strand openings, and the one or more multi-wire strands extend through the one or more strand openings and engage the one or more strand chucks.

Another system for a strand-to-threadbar coupler block for prestressed concrete includes a first concrete member and a second concrete member. The system includes one or more multi-wire strands disposed within the first concrete member and a strand-to-threadbar coupler block disposed within the first concrete member. The strand-to-threadbar coupler block is formed with a threadbar opening to admit a threadbar, and with one or more strand openings. The system includes one or more strand chucks coupled to the strand-to-threadbar coupler block at the one or more strand openings. A chuck diameter for the one or more strand chucks is greater than a diameter for the one or more strand openings, and the one or more multi-wire strands extend through the one or more strand openings and engage the one or more strand chucks. The system includes a threadbar anchorage affixed to the second concrete member. The threadbar extends from the threadbar opening in a direction opposite to the one or more multi-wire strands to the threadbar anchorage and the threadbar couples the first concrete member to the second concrete member. The system includes a threadbar nut coupling the threadbar to the strand-to-threadbar coupler block such that tensioning the threadbar displaces the strand-to-threadbar coupler block and increases tension on the one or more multi-wire strands.

Another system for a strand-to-threadbar coupler block for prestressed concrete includes a first concrete member, a second concrete member and one or more multi-wire strands disposed within the first concrete member. The system includes a strand-to-threadbar coupler block disposed within the first concrete member. The strand-to-threadbar coupler block is formed with a threadbar opening to admit a threadbar, and with one or more strand openings. The system includes one or more strand chucks coupled to the strand-to-threadbar coupler block at the one or more strand openings. A chuck diameter for the one or more strand chucks is greater than a diameter for the one or more strand openings, and the one or more multi-wire strands extend through the one or more strand openings and engage the one or more strand chucks. The system includes a threadbar anchorage affixed to the second concrete member. The threadbar extends from the threadbar opening in a direction opposite to the one or more multi-wire strands to the threadbar anchorage and the threadbar couples the first concrete member to the second concrete member. The system includes a threadbar nut coupling the threadbar to the strand-to-threadbar coupler block such that tensioning the threadbar displaces the strand-to-threadbar coupler block and increases tension on the one or more multi-wire strands. The threadbar nut is affixed to the strand-to-threadbar coupler block and the threadbar anchorage includes a second threadbar nut for tensioning the threadbar. The system includes a void in the first concrete member positioned to permit access to the threadbar nut for tensioning the threadbar and a strand covering that covers at least a portion of the one or more multi-wire strands, proximate to the strand-to-threadbar coupler block, such that the portion of the one or more multi-wire strands proximate to the strand-to-threadbar coupler block is unbonded to the first concrete member.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore considered to be limiting of its scope, the invention will be described and explained with additional specificity and detail through the use of the accompanying drawings, in which.

DETAILED DESCRIPTION

Figure 1:
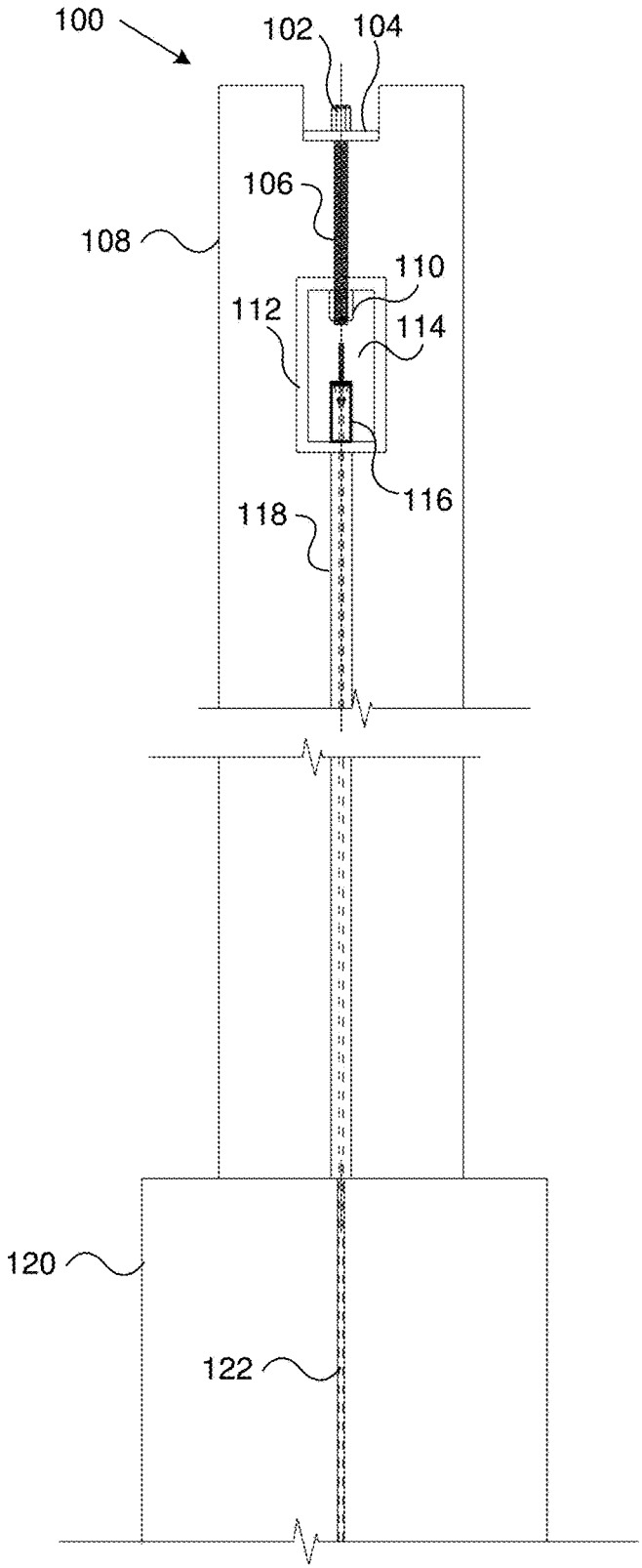
FIG. 1 is a cross section view illustrating one embodiment of a system including a strand-to-threadbar coupler block.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are included to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

A system for a strand-to-threadbar coupler block for prestressed concrete is disclosed. A system includes a concrete member, one or more multi-wire strands disposed within the concrete member, and a strand-to-threadbar coupler block disposed within the concrete member. The strand-to-threadbar coupler block is formed with a threadbar opening to admit a threadbar, and with one or more strand openings. The system includes one or more strand chucks coupled to the strand-to-threadbar coupler block at the one or more strand openings. A chuck diameter for the one or more strand chucks is greater than a diameter for the one or more strand openings, and the one or more multi-wire strands extend through the one or more strand openings and engage the one or more strand chucks.

In some embodiments, the system includes a threadbar anchorage, where the threadbar extends from the threadbar opening in a direction opposite to the one or more multi-wire strands to the threadbar anchorage, and a threadbar nut coupling the threadbar to the strand-to-threadbar coupler block such that tensioning the threadbar displaces the strand-to-threadbar coupler block and increases tension on the one or more multi-wire strands. In other embodiments, the threadbar nut is affixed to the strand-to-threadbar coupler block and the threadbar anchorage includes a second threadbar nut for tensioning the threadbar. In other embodiments, the system includes a void in the concrete member positioned to permit access to the threadbar nut for tensioning the threadbar. In other embodiments, the system includes a second concrete member where the threadbar anchorage is affixed to the second concrete member such that the threadbar couples the concrete member to the second concrete member.

In some embodiments, the system includes a strand covering that covers at least a portion of the one or more multi-wire strands, proximate to the strand-to-threadbar coupler block, such that the portion of the one or more multi-wire strands proximate to the strand-to-threadbar coupler block is unbonded to the concrete member. In other embodiments, the strand-to-threadbar coupler block is disposed in a void within the concrete member, the void is larger than the strand-to-threadbar coupler block and the void permits movement of the strand-to-threadbar coupler block in a direction that increases tension on the one or more multi-wire strands. In other embodiments, the system includes a compressible material disposed on one side of the strand-to-threadbar coupler block, such that movement of the strand-to-threadbar coupler block in a direction that compresses the compressible material and increases tension on the one or more multi-wire strands.

In some embodiments, the strand-to-threadbar coupler block is coated in a release agent that prevents bonding of the strand-to-threadbar coupler block to the concrete member. In other embodiments, the strand-to-threadbar coupler block includes a first plate coupled to a second plate disposed across a central void from the first plate, the first plate is coupled to the one or more strand chucks and the second plate includes the threadbar opening. In other embodiments, the strand-to-threadbar coupler block includes a plate with a central portion and a peripheral portion, the threadbar opening is formed in the central portion and the one or more strand chucks are coupled to the peripheral portion.

Another system for a strand-to-threadbar coupler block for prestressed concrete includes a first concrete member and a second concrete member. The system includes one or more multi-wire strands disposed within the first concrete member and a strand-to-threadbar coupler block disposed within the first concrete member. The strand-to-threadbar coupler block is formed with a threadbar opening to admit a threadbar, and with one or more strand openings. The system includes one or more strand chucks coupled to the strand-to-threadbar coupler block at the one or more strand openings. A chuck diameter for the one or more strand chucks is greater than a diameter for the one or more strand openings, and the one or more multi-wire strands extend through the one or more strand openings and engage the one or more strand chucks. The system includes a threadbar anchorage affixed to the second concrete member. The threadbar extends from the threadbar opening in a direction opposite to the one or more multi-wire strands to the threadbar anchorage and the threadbar couples the first concrete member to the second concrete member. The system includes a threadbar nut coupling the threadbar to the strand-to-threadbar coupler block such that tensioning the threadbar displaces the strand-to-threadbar coupler block and increases tension on the one or more multi-wire strands.

In some embodiments, the threadbar nut is affixed to the strand-to-threadbar coupler block and the threadbar anchorage includes a second threadbar nut for tensioning the threadbar. In other embodiments, the system includes a void in the first concrete member positioned to permit access to the threadbar nut for tensioning the threadbar. In other embodiments, the system includes a strand covering that covers at least a portion of the one or more multi-wire strands, proximate to the strand-to-threadbar coupler block, such that the portion of the one or more multi-wire strands proximate to the strand-to-threadbar coupler block is unbonded to the first concrete member. In other embodiments, the strand-to-threadbar coupler block is disposed in a void within the first concrete member, the void is larger than the strand-to-threadbar coupler block and the void permits movement of the strand-to-threadbar coupler block in a direction that increases tension on the one or more multi-wire strands.

In some embodiments, the system includes a compressible material disposed on one side of the strand-to-threadbar coupler block, such that movement of the strand-to-threadbar coupler block in a direction that compresses the compressible material and increases tension on the one or more multi-wire strands. In other embodiments, the strand-to-threadbar coupler block includes a first plate coupled to a second plate disposed across a central void from the first plate, the first plate is coupled to the one or more strand chucks and the second plate comprises the threadbar opening. In other embodiments, the first concrete member is a counterfort and the second concrete member is a retaining wall and the counterfort extends into a hillside behind the retaining wall.

Another system for a strand-to-threadbar coupler block for prestressed concrete includes a first concrete member, a second concrete member and one or more multi-wire strands disposed within the first concrete member. The system includes a strand-to-threadbar coupler block disposed within the first concrete member. The strand-to-threadbar coupler block is formed with a threadbar opening to admit a threadbar, and with one or more strand openings. The system includes one or more strand chucks coupled to the strand-to-threadbar coupler block at the one or more strand openings. A chuck diameter for the one or more strand chucks is greater than a diameter for the one or more strand openings, and the one or more multi-wire strands extend through the one or more strand openings and engage the one or more strand chucks. The system includes a threadbar anchorage affixed to the second concrete member. The threadbar extends from the threadbar opening in a direction opposite to the one or more multi-wire strands to the threadbar anchorage and the threadbar couples the first concrete member to the second concrete member. The system includes a threadbar nut coupling the threadbar to the strand-to-threadbar coupler block such that tensioning the threadbar displaces the strand-to-threadbar coupler block and increases tension on the one or more multi-wire strands. The threadbar nut is affixed to the strand-to-threadbar coupler block and the threadbar anchorage includes a second threadbar nut for tensioning the threadbar. The system includes a void in the first concrete member positioned to permit access to the threadbar nut for tensioning the threadbar and a strand covering that covers at least a portion of the one or more multi-wire strands, proximate to the strand-to-threadbar coupler block, such that the portion of the one or more multi-wire strands proximate to the strand-to-threadbar coupler block is unbonded to the first concrete member.

FIG. 1 depicts one embodiment of a system 100 including a strand-to-threadbar coupler block 112. In FIG. 1, two concrete members 108, 120 are viewed from the side, and a cross section is taken through the concrete members 108, 120 to show components internal to either or both of the concrete members 108, 120, such as the strand-to-threadbar coupler block 112. For convenience in depicting components internal to the concrete members 108, 120, the concrete members 108, 120 and internal components are not depicted along their full length in FIG. 1. Portions of the concrete members 108, 120 and other components are omitted from FIG. 1 as indicated by jagged lines.

Terms such as "side," "top," "bottom," or the like are used herein to provide some clarity of description when dealing with relative relationships. Unless otherwise stated, such terms refer to an orientation of linear or elongate components such as threadbar or multi-wire strand in which the full length of the component might be viewed from the "side" (if unobscured by other materials such as concrete) and in which a view from the "top" or "bottom" would be end-on to the threadbar, multi-wire strand or other component. However, these terms are not intended to imply absolute relationships, positions, and/or orientations. For example, the view of the system 100 from the "side" in FIG. 1 might be a truly horizontal view if the concrete members 108, 120 form a vertical pillar (e.g. to support a beam or girder), or might be a view from above if the concrete members 108, 120 form a horizontal structure such as a counterfort that extends horizontally into a hillside to anchor a retaining wall. Nevertheless, the system 100 is still the same structure, and the view in FIG. 1 may still be referred to as a "side" view.

In the depicted embodiment, the system 100 includes at least one concrete member 108, 120, a multi-wire strand 122, a strand-to-threadbar coupler block 112, and a strand chuck 116, which are described below. Although the depicted embodiment includes one strand chuck 116 and one multi-wire strand 122, another embodiment of a system 100 may include one or more strand chucks 116, and one or more multi-wire strands 122.

A concrete member 108, 120 may include any concrete structure, such as a pillar, a beam, a girder, a caisson, a wall, a roof, a buttress, one or more components of a counterfort, or the like. Components such as multi-wire strand 122 or threadbar 106 are used to prestress one or more concrete members 108, 120, where tensioning internal components such as multi-wire strand 122 or threadbar 106 compresses one or more concrete members 108, 120. In various embodiments, concrete members 108, 120 may be precast concrete, or may be cast-in-place. Various types of prestressed concrete members will be recognized as suitable for use in a system 100. In some embodiments, prestressed concrete members 108, 120 may include (or omit) additional components not depicted in the Figures, such as rebar for reinforcement, bursting reinforcement at or near anchorages for multi-wire strand 122 or threadbar 106, or the like.

In the depicted embodiment, a multi-wire strand 122, a threadbar 106, and a strand-to-threadbar coupler block 112 are used to compress and join two concrete members 108, 120 (e.g., by post-tensioning of the threadbar 106). In another embodiment, multi-wire strand 122, threadbar 106, and a strand-to-threadbar coupler block 112 may be used to prestress or compress a single concrete member 108 without joining it to a second concrete member 120. (e.g., one prestressed concrete member 108 may not be coupled to a second concrete member 120, or may be coupled to a second concrete member 120 in another way.

In various embodiments, one or more multi-wire strands 122 may be disposed within at least one of the concrete members 108, 120. Multi-wire strand 122 may be steel strand that is commercially available for prestressing concrete, such as 2-wire strand, 3-wire strand, 7-wire strand and 19-wire strand or the like. Multi-wire strand 122 in various embodiments may include sleeved or ducted strand that is covered to prevent the steel from bonding directly to the concrete, or may include strand with surface treatments such as nicks that facilitate bonding to the concrete (e.g., if the multi-wire strand 122 is tensioned prior to casting of the concrete). A duct or tube may be cast into one or both of the concrete members 108, 120 allowing at least one of the concrete members 108, 120 to be precast, and subsequently coupled to the other concrete member 108, 120 by inserting the strand 122 through the duct or tube. Sleeved or ducted strand may later be bonded to concrete by pressure grouting, or may be kept unbonded. Various types of multi-wire strand 122 will be recognized as suitable for prestressing concrete in a system 100. Multi-wire strand 122 disposed within a concrete member 108, 120 may extend through or be pre-tensioned through the entire length of a concrete member 108, 120 (e.g., if strand anchorages are external to the concrete member), or may extend through or be pre-tensioned through a portions of a concrete member 108, 120 (e.g., if a strand anchorage such as the strand-to-threadbar coupler block 112 and strand chuck 116 are disposed within a concrete member 108, 120).

In the depicted embodiment, a multi-wire strand 122 extends through one concrete member 120, with an anchorage at or near an end of the concrete member 120 (with the anchorage not shown due to truncation of the concrete member 120 in FIG. 1), and extends through at least a portion of another concrete member 108. In the depicted embodiment, concrete member 108 includes a duct 118 that covers the strand 122, but concrete member 120 does not include a duct, leaving the strand 122 in concrete member 120 unducted, and bonded to the surrounding concrete. In some embodiments, one or more strands 122 may be bonded to concrete within portions of one or more concrete members 108, 120, or may be unbonded to concrete along the full length of the strand 122. A multi-wire strand 122 that is unbonded to concrete may be covered by a duct 118, a spiral wrap, a sleeve, or other means such as a coating of grease or another release agent, to separate the strand from the concrete or prevent bonding.

Threadbar 106, in various embodiments, may include steel bar that is fully threaded, threaded at ends but smooth along the length to prevent bonding to concrete, or the like. Threads allow threadbar 106 to be tensioned to prestress one or more concrete members 108, 120 by applying torque to threadbar nuts 102, 110 at anchorages. In some embodiments, threadbar 106 may be bonded to concrete of one or more concrete members 108, 120. In another embodiment, threadbar 106 may be coated, covered by a duct, covered by a sleeve, or the like, to prevent the threadbar from bonding to the surrounding concrete. Threadbar unbonded to the surrounding concrete may move relative to the concrete to facilitate post-tensioning of the threadbar to compress the concrete. Various types of threadbar 106 will be recognized as suitable for prestressing or compressing concrete in a system 100.

In general, threadbar 106 is more rigid than multi-wire strand 122 and less prone to loss of initial prestressing tension than multi-wire strand 122, but is also significantly more expensive per unit length than multi-wire strand 122. Conversely, multi-wire strand 122 may be less expensive than threadbar 106, but is also more prone to loss of initial prestressing tension. Loss of initial prestressing tension may reduce the effective tension in the strand 122, thus reducing the induced compression of the concrete. The loss of prestressing tension in multi-wire strand 122 may be particularly problematic for shorter length concrete members. For example, slippage of an eighth of an inch when a tensioned multi-wire strand 122 seats into a strand anchorage may result in a smaller loss of tension in a strand 122 that extends through two hundred feet of concrete, but may result in a larger loss of tension in a strand 122 that extends only a few feet between anchorages. Thus, strand 122 may be more suitable than threadbar 106 for prestressing long concrete structures due to the decreased per-length cost compared to threadbar 106 and the smaller prestress loss compared to shorter lengths of strand 122. On the other hand, threadbar 106 may be more suitable than strand 122 for compressing short concrete structures by post-tensioning the threadbar 106, where the per-length expense is less significant and where short lengths of strand 122 would be subject to large prestress loss.

However, a problem arises for prestressing intermediate-length concrete structures. A structure may be of sufficient length so that threadbar 106 is prohibitively expensive, but may also be short enough that loss of initial prestress tension in strand 122 is particularly significant. Providing additional multi-wire strands 122 may compensate for the prestress loss per strand 122, but may increase the overall size and expense of the structure.

Accordingly, in various embodiments, one or more concrete members 108, 120 may be compressed (and, possibly, connected to each other) by a combination of threadbar 106 and multi-wire strand 122, with the threadbar 106 and the multi-wire strand 122 coupled together at a strand-to-threadbar coupler block 112. In some embodiments, a threadbar 106 may extend in one direction from the strand-to-threadbar coupler block 112 and one or more multi-wire strands 122 may extend from the strand-to-threadbar coupler block 112 in a direction opposite to the direction in which the threadbar 106 extends. Thus, the strand-to-threadbar coupler block 112 may transmit tension applied to the threadbar 106 to the one or more multi-wire strands 122. In some embodiments, the transition from strand 122 to threadbar 106 at a strand-to-threadbar coupler block 112 may allow concrete to be effectively prestressed or compressed at a lower expense than by using threadbar 106 alone, and with lower prestress loss than by using strand 122 alone, because the loss of initial prestress tension in the strand 122 may be mitigated (and the strand 122 re-tensioned) by applying torque to one of the threadbar nuts 102, 110.

The strand-to-threadbar coupler block 112, in the depicted embodiment, is disposed within a concrete member 108. In one embodiment, a strand-to-threadbar coupler block 112 may be disposed within a concrete member 108 by casting the concrete member 108 around the strand-to-threadbar coupler block 112 (and other components such as strand 122). In another embodiment, a strand-to-threadbar coupler block 112 may be disposed within a concrete member 108 by casting the concrete member 108 with a void or recess extending to the outside of the concrete member 108 from the intended location of the strand-to-threadbar coupler block 112, then inserting the strand-to-threadbar coupler block 112 through the void or recess.

A strand-to-threadbar coupler block 112, in various embodiments, is formed with a threadbar opening to admit a threadbar 106 and with one or more strand openings. Threadbar openings and strand openings are not directly visible in the side view of FIGS. 1-3, but are depicted in the top view FIG. 4. In the depicted embodiment, the threadbar 106 extends through the threadbar opening at the top of the strand-to-threadbar coupler block 112, and is engaged by a threadbar nut 110. Similarly, in the depicted embodiment, the strand 122 extends through a strand opening, and is engaged by a strand chuck 116. In various embodiments, threadbar openings and strand openings may be holes, slots, or other openings formed in a strand-to-threadbar coupler block 112, where the threadbar openings and strand openings are large enough to admit threadbar 106 or strand 122, respectively. Similar openings may be found in commercially available anchorages for strand 122 or threadbar 106.

In one embodiment, the number of strand openings in a strand-to-threadbar coupler block 112 may equal the number of multi-wire strands 122 that are engaged by strand chucks 116 at the strand-to-threadbar coupler block 112. For example, a strand-to-threadbar coupler block 112 may include one strand opening for one strand 122, two strand openings for two strands 122, or the like. In another embodiment, the number of strand openings in a strand-to-threadbar coupler block 112 may be greater than the number of multi-wire strands 122 that are engaged by strand chucks 116 at the strand-to-threadbar coupler block 112. For example, a strand-to-threadbar coupler block 112 with four strand openings may be used with two strands 122, with two of the strand openings unused.

In various embodiments, one or more strand chucks 116 are coupled to the strand-to-threadbar coupler block 112 at the one or more strand openings. A strand chuck 116, in some embodiments, may be any device for engaging multi-wire strand 122 for tensioning or anchoring the strand 122. In the depicted embodiment, a strand chuck 116 includes a body and jaws, both with a longitudinal hole for strand insertion. Strand 122 may be inserted through the body and the jaws. The jaws may be a split or partially split wedge or cone (represented as a triangle in the Figures), where a split allows the jaws to be tightened around the strand 122. The body may include a tapered seat, so that applying tension to the strand 122 or to the strand chuck 116 in a direction substantially parallel to the strand 122 pulls the jaws into the seat, compressing the split in the jaws so that the strand 122 is firmly engaged by or clamped in the strand chuck 116 (at least while seating tension is above a threshold level). Various commercially available strand chucks 116 will be recognized as suitable for use in a system 100.

In one embodiment, a strand chuck 116 may be permanently coupled to the strand-to-threadbar coupler block 112 (e.g., by welding). In another embodiment, a strand chuck 116 coupled to the strand-to-threadbar coupler block 112 may simply be in contact with the strand-to-threadbar coupler block 112, and may be held in place by tension on the strand 122. One or more multi-wire strands 122 may extend through the one or more strand openings in the strand-to-threadbar coupler block 112 and may engage or be engaged by (e.g., be inserted through or clamped in) the one or more strand chucks 116.

In the depicted embodiment, a chuck diameter for the one or more strand chucks 116 is greater than a diameter for the one or more strand openings. With the diameter of a strand chuck 116 greater than the diameter of an adjacent strand opening, tension in the strand 122 pulls the strand chuck 116 toward or against a surface of the strand-to-threadbar coupler block 112, but not through the strand opening. Thus, the combination of the strand-to-threadbar coupler block 112 and a strand chuck 116 anchors the engaged strand 122 at the strand-to-threadbar coupler block 112, allowing tension to be maintained along the length of the strand 122 for prestressing one or more concrete members 108, 120. In the depicted embodiment, the threadbar nut 110 is similarly of greater diameter than a threadbar opening in the strand-to-threadbar coupler block 112, for maintaining tension in the threadbar 106 without pulling the nut 110 through the opening.

A strand-to-threadbar coupler block 112, in various embodiments, may be made of a material capable of transferring tension between the strand 122 and the threadbar 106. In some embodiments, such a material may have a tensile load capacity equal to or greater than a tensile load capacity of the strand 122 and/or the threadbar 106. For example, in various embodiments, a strand-to-threadbar coupler block 112 may be made of steel, carbon fiber composite material, or the like.

In the depicted embodiment, the system 100 includes strand 122 and threadbar 106. In another embodiment a system 100 may be provided or manufactured without some of the components depicted in FIG. 1, and other components may be added by a user. For example, in one embodiment, a system 100 may omit the threadbar 106, but may include a duct permitting a user to insert and tension threadbar 106 to compress a concrete member 208. Similarly, an apparatus for prestressing or compressing concrete may include one or more components of the system 100, such as the strand-to-threadbar coupler block 112 and strand chucks 116 coupled to the strand-to-threadbar coupler block 112. Such an apparatus may be used in a method for prestressing concrete by disposing the strand-to-threadbar coupler block 112 in a concrete member and coupling one or more strands 122 to the one or more strand chucks 116. In a further embodiment, a method for prestressing or compressing concrete may include providing the threadbar 106, coupling the threadbar 106 to the strand-to-threadbar coupler block 112, and tensioning the threadbar 106 to increase tension in the one or more strands 122.

In some embodiments, a system 100 includes the threadbar 106, which extends from the threadbar opening in the strand-to-threadbar coupler block 112, in a direction opposite to the one or more multi-wire strands 122 (e.g., up from the strand-to-threadbar coupler block 112 in FIG. 1 while the strand 122 extends down from the strand-to-threadbar coupler block 112), to a threadbar anchorage 104. The threadbar 106, in some embodiments, may be substantially parallel or colinear to the one or more multi-wire strands 122. A variety of commercially available threadbar anchorages 104 or bearing plates, and of threadbar nuts 102, 110, will be recognized as suitable for use in a system 100. In some embodiments, a threadbar nut 110 couples the threadbar 106 to the strand-to-threadbar coupler block 112 so that tensioning the threadbar 106 displaces the strand-to-threadbar coupler block 112 and increases tension on the one or more multi-wire strands 122. In further embodiments, tensioning the threadbar 106 may include tightening the threadbar nut 110 at the strand-to-threadbar coupler block 112 and/or the threadbar nut 102 at the threadbar anchorage 104.

In various embodiments, tensioning the threadbar 106 may compensate for loss of initial prestress tension in one or more multi-wire strands 122 by re-tensioning or increasing the effective tension in the one or more multi-wire strands 122. Increasing the effective tension in multi-wire strand 122, in various embodiments, may involve elongation of the strand 122 according to a stress/strain relationship, and thus may involve displacement of the strand-to-threadbar coupler block 112 parallel or colinear to the strand orientation. In some embodiments, a strand-to-threadbar coupler block 112 may be disposed in a void in concrete member 108, where the void is larger than the strand-to-threadbar coupler block 112 to permit movement of the strand-to-threadbar coupler block 112 and elongation of the strand 122. Voids in concrete for movement of a strand-to-threadbar coupler block 112 are discussed in further detail below with reference to subsequent Figures.

In one embodiment, the threadbar nut 110 for coupling the threadbar 106 to the strand-to-threadbar coupler block 112 may be affixed to the strand-to-threadbar coupler block 112. For example, the threadbar nut 110 may be welded to the strand-to-threadbar coupler block 112, formed integrally with the strand-to-threadbar coupler block 112 as a captive nut or threaded opening or the like. An affixed threadbar nut 110 may not be rotatable relative to the strand-to-threadbar coupler block 112, and may or may not be accessible (e.g., if the threadbar nut 110 is internal to a concrete member 108 without a void in the concrete member 108 being provided for accessing the threadbar nut 110). Thus, the threadbar anchorage 104 may include a second threadbar nut 102 for tensioning the threadbar 106. In such an embodiment, the threadbar anchorage 104 and threadbar nut 102 may be disposed at an outer surface of the concrete member 108 or in a recess or void in the concrete member 108 providing access to the threadbar nut 102. In some embodiments, torquing the threadbar nut 102 to tension the threadbar 106 may move the threadbar 106 relative to the concrete member 108, and the threadbar 106 may be unbonded to the surrounding concrete (e.g., if the threadbar 106 is ducted or sleeved) to permit such movement.

In another embodiment, a void 114 in the concrete member 108 may permit access to the threadbar nut 110 that couples the threadbar 106 to the strand-to-threadbar coupler block 112, for tensioning the threadbar 106. For example, an access tube or void 114 may extend from a side of the concrete member 108 to the threadbar nut 110, allowing the threadbar 106 to be tensioned by torquing the threadbar nut 110. In some embodiments, torquing the threadbar nut 110 to tension the threadbar 106 may result in movement of the strand-to-threadbar coupler block 112 to increase tension in the strand 122 without significant movement or elongation of the thicker or more rigid threadbar 106, and the threadbar 106 may be bonded to the surrounding concrete. Additionally, in some embodiments, with access to the threadbar nut 110 provided via a void 114, the other end of the threadbar 106 may be anchored internally to the concrete, without an externally accessible anchorage 104 or nut 102. For example, the anchorage 104 may be cast into the concrete member 108.

In some embodiments, a strand covering may cover at least a portion of the one or more multi-wire strands 122 proximate to the strand-to-threadbar coupler block 112, so that the portion of the one or more multi-wire strands 122 proximate to the strand-to-threadbar coupler block 112 is unbonded to the concrete member 108. For example, in the depicted embodiment, the strand covering is a duct 118 within the concrete member 108. In another embodiment, multi-wire strand 122 may be sleeved strand that is covered by a sleeve along its length. Sleeved strand may be unbonded to the concrete member 108 (i.e., concrete may be in contact with or bonded to a sleeve of the sleeved strand but not to the strand within the sleeve) along substantially the full length of the strand 122 or the concrete member 108, including at a portion of the strand 122 proximate to the strand-to-threadbar coupler block 112. In another embodiment, multi-wire strand 122 may be bonded to the surrounding concrete (e.g., uncovered by a duct 118 or other strand covering) in at least a portion of the concrete member 108, but may be covered by a strand covering such as a spiral wrap covering applied to the strand 122 along a portion of the strand 122 proximate to the strand-to-threadbar coupler block 112, and thus unbonded to the concrete surrounding the covered portion.

As described above, increasing the effective tension in the strand 122 to compensate for loss of initial prestress tension may involve elongation of the strand 122 according to a stress/strain relationship. In various embodiments, providing a covered and unbonded length of strand 122 proximate to the strand-to-threadbar coupler block 112 may permit elongation of the strand 122. In some embodiments, the length of the covered portion proximate to the strand-to-threadbar coupler block 112 may be based on an expected amount of elongation of the strand 122. For example, a shorter portion of the strand 122 may be covered and unbonded if a small amount of elongation is desired or expected, and a longer portion of the strand 122 may be covered and unbonded if a larger amount of elongation is desired or expected.

Figure 2:
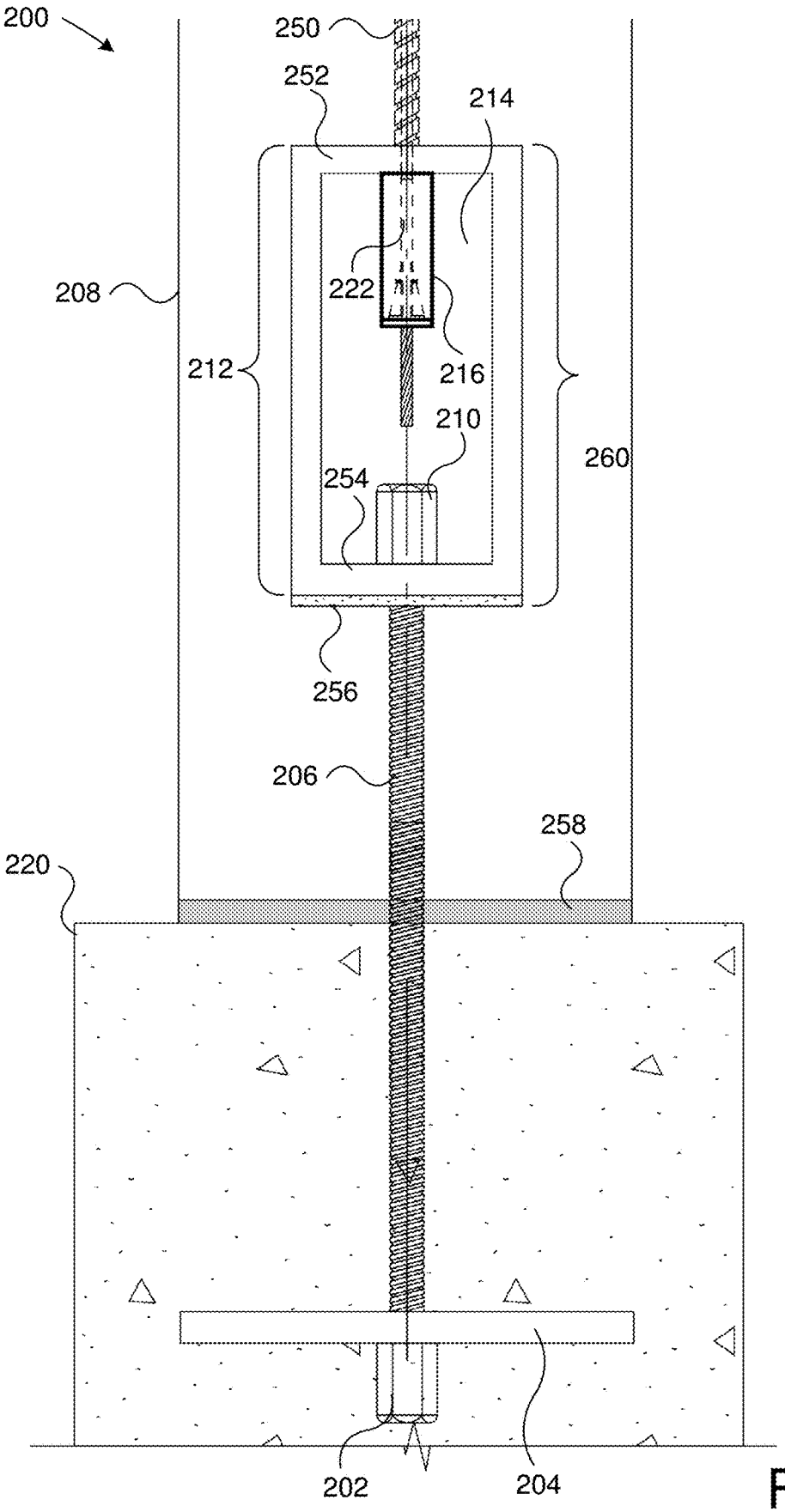
FIG. 2 is a cross section view illustrating another embodiment of a system including a strand-to-threadbar coupler block.

FIG. 2 depicts another embodiment of a system 200 including a strand-to-threadbar coupler block 212. In FIG. 2, two concrete members 208, 220 are viewed from the side, and a cross section is taken through the concrete members 208, 220 to show components internal to either or both of the concrete members 208, 220, such as the strand-to-threadbar coupler block 212. For convenience in depicting components internal to the concrete members 208, 220, the concrete members 208, 220 and other components are not depicted along their full length in FIG. 2. Portions of concrete members 208, 220 and other components are depicted near the junction of the two concrete members 208, 220, but other portions of the concrete members 208, 220 and other components (e.g., above or below the depicted portions) are not shown in FIG. 2.

In the depicted embodiment, the system 200 is substantially similar to the system 100 described above with reference to FIG. 1, including concrete members 208, 220, a multi-wire strand 222, a strand-to-threadbar coupler block 212, a strand chuck 216, an access void 214, threadbar nuts 202, 210, a threadbar anchorage 204, and a threadbar 206, which may be substantially as described above, like numbers referring to like elements (i.e. strand 122 of FIG. 1 is similar to strand 222 of FIG. 2, strand-to-threadbar coupler block 112 in FIG. 1 is similar to strand-to-threadbar coupler block 212 in FIG. 2, etc.). Additionally, in the depicted embodiment, the system 200 includes a spiral wrap 250, a void 260 larger than the strand-to-threadbar coupler block 212, and compressible material 256, 258, which are described below. In the depicted embodiment, the strand-to-threadbar coupler block 212 includes a first plate 252 coupled to a second plate 254, which are described below.

In FIG. 1, multi-wire strand 122 extends through both concrete members 108, 120, and the threadbar 106 was disposed in only one of the concrete members 108, with the threadbar anchorage 104 in the same concrete member 108 as the strand-to-threadbar coupler block 112. Conversely, in the embodiment depicted in FIG. 2, the strand 222 (which extends through strand chuck 216 and the spiral wrap 250) is disposed in only one of the concrete members 208, the strand-to-threadbar coupler block 212 is disposed in that concrete member 208. The threadbar anchorage 204 is affixed to, coupled to, or disposed within a second concrete member 220 so that the threadbar 206 couples the first concrete member 208 to the second concrete member 220, while compressing one or both of the concrete members 208, 220. In the depicted embodiment, the threadbar nut 202 at the anchorage 204 is covered in concrete and not accessible, so the threadbar 206 is tensioned by torquing the other threadbar nut 210. In another embodiment, however, a recess in the concrete member 220 may provide access to the threadbar nut 202.

As described above, a strand covering may cover at least a portion of one or more multi-wire strands 222 proximate to a strand-to-threadbar coupler block 212, so that the portion of the one or more multi-wire strands 222 proximate to the strand-to-threadbar coupler block 212 is unbonded to a concrete member 208. In the depicted embodiment, the strand covering is a spiral wrap 250. Spiral wrap 250 may be wrapped around a portion of a multi-wire strand 222, so that the wrapped portion is covered and unbonded to the surrounding concrete. Another portion of the multi-wire strand 222 may be uncovered, and bonded to the surrounding concrete. Use of spiral wrap 250 may facilitate selectively covering a portion of the multi-wire strand 222 rather than covering the entire multi-wire strand 222. Various types of commercially available spiral wrap 250 will be recognized as suitable for use as a strand covering.

Also, as described above, tensioning the threadbar 206 may move the strand-to-threadbar coupler block 212, increasing tension and elongation of the strand 222. Thus, in the depicted embodiment, the strand-to-threadbar coupler block 212 is disposed in a void 260 within the concrete member 208. In the depicted embodiment, the void 260 is larger than the strand-to-threadbar coupler block 212, and permits movement of the strand-to-threadbar coupler block 212 in a direction that increases tension on the one or more multi-wire strands 222. Specifically, in the depicted embodiment, the void 260 provides space on the threadbar side of the strand-to-threadbar coupler block 212, allowing the strand-to-threadbar coupler block 212 to move along or with the threadbar 206 as the threadbar 206 is tensioned, which in turn results in elongation and increased tension in the strand 222.

A void 260 larger than a strand-to-threadbar coupler block 212 may be formed by casting the concrete around the strand-to-threadbar coupler block 212 plus a compressible or removable spacer. In the depicted embodiment, a compressible material 256 is disposed on one side of the strand-to-threadbar coupler block 212 (e.g., in the direction that the threadbar 206 extends away from the strand-to-threadbar coupler block 212). Movement of the strand-to-threadbar coupler block 212 in the direction that compresses the compressible material 256 (e.g., as a result of rotating the nut 210) may increase tension on one or more multi-wire strands 222. For example, movement of the strand-to-threadbar coupler block 212 downwards in FIG. 2 moves the strand chuck 216 downwards to elongate and increase tension in the strand 222.

The compressible material 256, in various embodiments, may be an elastomeric coating, an elastomeric pad, or the like. In some embodiments, a compressible material 256 may be selected with a durometer rating based on an expected or desired amount of prestress force. In the depicted embodiment, compressible material 258 is compressed between the concrete members 208, 220. The compressible material 258, like the compressible material 256, may have a durometer rating based on an expected or desired amount of prestress force. Compression of the compressible material 258 may distribute prestress force across the junction of the concrete members 208, 220, rather than concentrating prestress force on high spots or a non-uniform mating surface. Various commercially available bearing pads may be used as compressible material 256, 258. In some embodiments, compressible material 258 may be omitted, and the junction between the concrete members 208, 220 may be shimmed and grouted.

The void 260, in the depicted embodiment, is larger than the strand-to-threadbar coupler block 212, but is filled by the strand-to-threadbar coupler block 212 and the compressible material 256. In another embodiment, the compressible material 256 may be omitted, and a void 260 larger than the strand-to-threadbar coupler block 212 may include empty space rather than a compressible material 256.

In some embodiments, a strand-to-threadbar coupler block 212 may be coated in a release agent that prevents bonding of the strand-to-threadbar coupler block 212 to the concrete member 208. A release agent may be a coating of oil, grease, or another material that prevents bonding of the strand-to-threadbar coupler block 212 to the concrete member 208, thus permitting movement of the strand-to-threadbar coupler block 212 within the void 260. In some embodiments, a strand-to-threadbar coupler block 212 may be separated from the concrete member 208 by a covering such as a section of a rectangular steel tube or a similar commercially available steel member, thus permitting movement of the strand-to-threadbar coupler block 212 inside the covering.

In the depicted embodiment, the strand-to-threadbar coupler block 212 includes a first plate 252 coupled to a second plate 254, with the second plate 254 disposed across a central void 214 from the first plate 252. In some embodiments, a first plate 252 may include the one or more strand openings, through which one or more multi-wire strands 222 extend to engage one or more strand chucks 216. The one or more strand chucks 216 may be coupled to the first plate 252. In further embodiments, a second plate 254 may include the threadbar opening, through which the threadbar 206 extends to engage the threadbar nut 210.

In the depicted embodiment, the first plate 252 and the second plate 254 at opposite ends of the strand-to-threadbar coupler block 212 are coupled together by side members that run the length of the strand-to-threadbar coupler block 212, so that the strand-to-threadbar coupler block 212 is box-shaped, with two closed sides and two open sides permitting access to the threadbar nut 210 and strand chuck 216. In another embodiment, a first plate 252 and a second plate 254 at opposite ends of a strand-to-threadbar coupler block 212 may be coupled together in another way, so that the strand-to-threadbar coupler block 212 is C-shaped, cage-shaped, or the like.

In the depicted embodiment, with one strand 222, the strand-to-threadbar coupler block 212 with the strand opening in a first plate 252 and the threadbar opening in a second plate 254 allows the strand 222 and the threadbar 206 to be substantially colinear, so that tension in the strand 222 and the threadbar 206 does not result in torsion of the strand-to-threadbar coupler block 212. In another embodiment, a dual-plate strand-to-threadbar coupler block 212 may be used in another embodiment with multiple strands 222.

Figure 3:
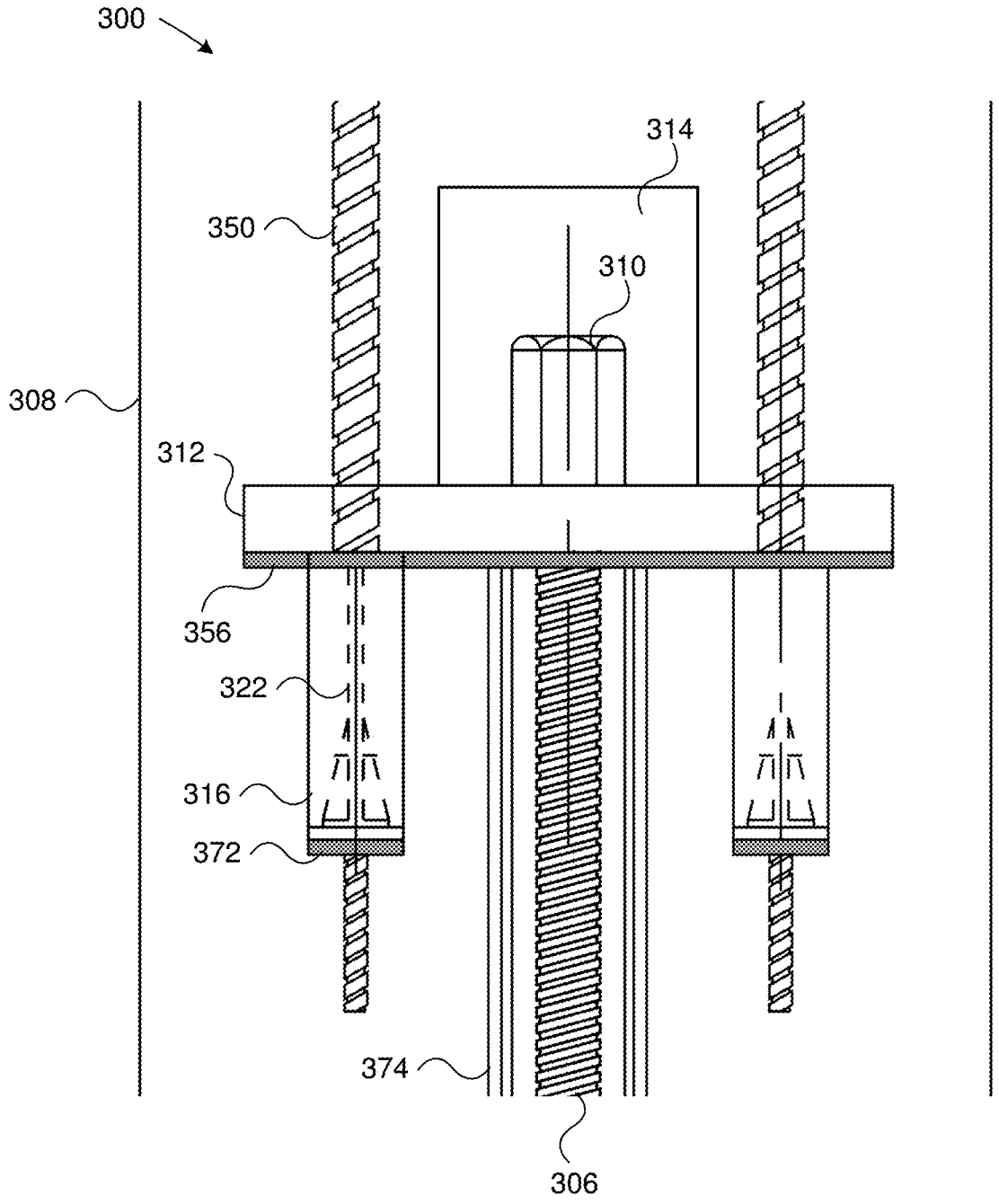
FIG. 3 is a cross section view illustrating another embodiment of a system including a strand-to-threadbar coupler block.

FIG. 3 depicts another embodiment of a system 300 including a strand-to-threadbar coupler block 312. In FIG. 3, a concrete member 308 is viewed from the side, and a cross section is taken through the concrete member 308 to show components internal to the concrete member 308, such as the strand-to-threadbar coupler block 312. For convenience in depicting components internal to the concrete member 308, the concrete member 308 and other components are not depicted along their full length in FIG. 3. Portions of concrete member 308 and other components are depicted near the strand-to-threadbar coupler block 312, but other portions of the concrete member 308 and of other components (e.g., above or below the depicted region) are not shown in FIG. 3.

In the depicted embodiment, the system 300 is substantially similar to the systems 100, 200 described above with reference to FIGS. 1 and 2, including a concrete member 308, a plurality of multi-wire strands 322, spiral wrap 350, a strand-to-threadbar coupler block 312, compressible material 356, strand chucks 316, an access void 314, a threadbar nut 310, a threadbar 306, which may be substantially as described above, like numbers referring to like elements. Additionally, in the depicted embodiment, the system 200 includes a compressible material 372 and a threadbar duct 374, which are described below.

In the depicted embodiment, the system 300 includes a plurality of multi-wire strands 322, engaged by a plurality of strand chucks 316. As in FIG. 2, the multi-wire strands 322 extend through the strand chucks 316 and the spiral wrap 350. As described above, the combination of strand 322 and threadbar 306 coupled at a strand-to-threadbar coupler block 312 may be used to compress a concrete member 308 and/or to join the concrete member 308 to a second concrete member. In FIGS. 1 and 2, a second concrete member was depicted. In FIG. 3, the system 300 may similarly be used with a second concrete member, but is depicted in use with a single concrete member 308.

In the depicted embodiment, the strand-to-threadbar coupler block 312 comprises a plate with a central portion and a peripheral portion, where the threadbar opening is formed in the central portion, and the one or more strand chucks 316 are coupled to the peripheral portion. For example, in FIG. 2, a central portion of the strand-to-threadbar coupler block 312 is towards the middle of the figure, where the threadbar 306 passes through a threadbar opening to engage a threadbar nut 310. The peripheral portions of the strand-to-threadbar coupler block 312 are towards either side of the figure, where the strand 322 passes through strand openings to engage the strand chucks 316. With multiple strands 322 passing through peripherally-located strand openings, a centrally located threadbar opening allows the sum of forces from the strands 322 to be aligned with (but opposite to) the force from the threadbar 306 without torsion of the strand-to-threadbar coupler block 312. Compared to the dual-plate strand-to-threadbar coupler block 112, 212 of preceding figures, a single-plate strand-to-threadbar coupler block 312 may be unable to align a single strand 322 with the threadbar 306, but may be lighter, less expensive, and simpler to manufacture.

However, the strand-to-threadbar coupler block 312 in the depicted embodiment does not provide a central void 214 between two plates 252, 254. Thus, a void 314 for accessing the threadbar nut 310 may be formed in another way when casting the concrete member 308. Alternatively, the void 314 may be omitted (e.g., filled with concrete) if the threadbar 306 can be tensioned from the other end (e.g., at a threadbar anchorage at an end of the concrete member 308).

Additionally, in the depicted embodiment, the strand chucks 316 are coupled to the exterior of the strand-to-threadbar coupler block 312, rather than being disposed in an interior recess. Thus, the strand-to-threadbar coupler block 312 and the strand chucks 316 may be coated in a release agent, as described above, and a compressible material 356, 372 may be disposed on one side of the strand-to-threadbar coupler block 312 and on ends of the strand chucks 316, so that movement of the strand-to-threadbar coupler block 312 and the strand chucks 316 compresses the compressible material 356, 372, and increases tension on the strands 322.

In the depicted embodiment, a threadbar duct 374 separates the threadbar 306 from the surrounding concrete of the concrete member 308. In some embodiments, the use of a threadbar duct 374 may allow a manufacturer to omit the threadbar 306 when casting the concrete member 308. The threadbar 306 may be subsequently added. For example, threadbar 306 precast into and extending from a second concrete member may be inserted through the duct 374 to engage the threadbar nut 310.

Figure 4:
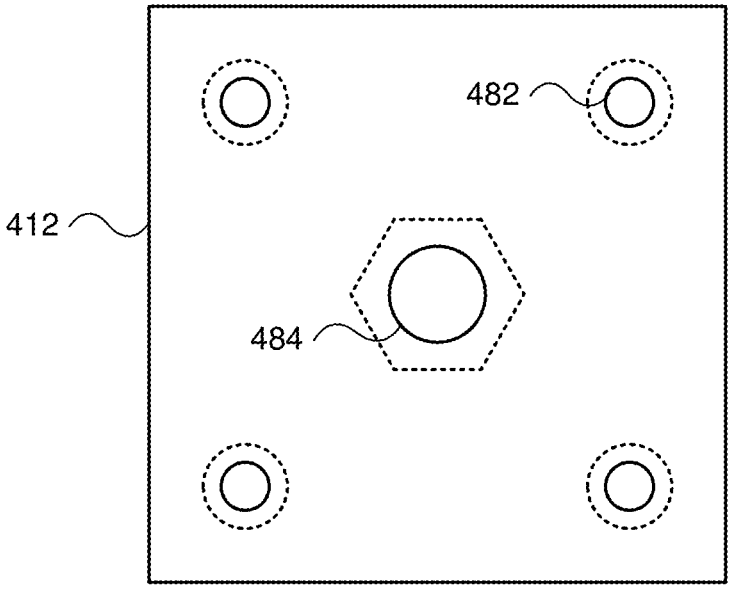
FIG. 4 is a top view illustrating one embodiment of a strand-to-threadbar coupler block.

FIG. 4 is a top view illustrating one embodiment of a strand-to-threadbar coupler block 412, which may be substantially similar to the strand-to-threadbar coupler block 312 described above with reference to FIG. 3. In the depicted embodiment, the strand-to-threadbar coupler block 412 includes a plate with a central portion and a peripheral portion. A threadbar opening 484 is formed in the central portion. Strand openings 482 are formed in the peripheral portion. Dashed lines indicate the "footprint" or outline of strand chucks 316 at the strand openings 482, and of a threadbar nut 310 at the threadbar opening 484. The diameter of the threadbar opening 484 is large enough to admit a threadbar 306, but smaller than the minimum width of the threadbar nut 310. Similarly, the diameter of the strand openings 482 is large enough to admit strands 322, but smaller than the width of a strand chuck 316.

In the depicted embodiment, the strand-to-threadbar coupler block 412 includes four strand openings 482 at corners of a square or rectangle, with the threadbar opening 484 at the center of the square or rectangle. Thus, the depicted strand-to-threadbar coupler block 412 may be used with four strands 322 or with two strands 322 at opposite corners of the square or rectangle. In another embodiment, a single-plate strand-to-threadbar coupler block 412 may include more or fewer strand openings 482 surrounding a central threadbar opening 484. For example, two strand openings 482 may be in a line on opposite sides of a threadbar opening 484, three strand openings 482 may be at corners of a triangle with the threadbar opening 484 at the center of the triangle, or the like.

Figure 5:
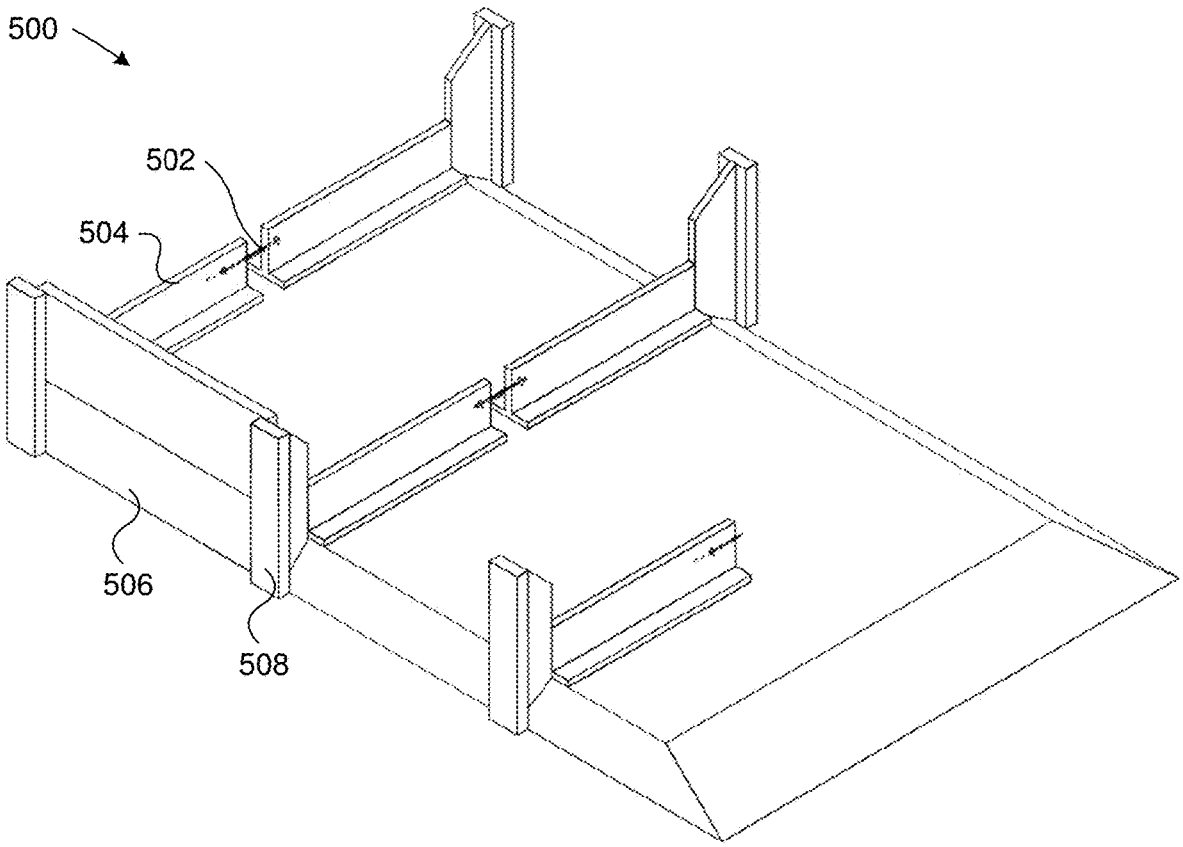
FIG. 5 is a perspective view illustrating opposing retaining walls, in one embodiment.

FIG. 5 is a perspective view illustrating opposing retaining walls 500, in one embodiment. Some parts of the walls 500 are omitted for convenience in seeing other components. In the depicted embodiment, retaining walls 500 include counterforts 504 that anchor the wall in soil. Counterforts 504 may be installed in slot cuts in a hillside, and the slot cuts may then be backfilled. Alternatively, in a constructed embankment, counterforts 504 may be installed before adding fill material to build up the height of the embankment. The counterforts 504 are joined to face joint members 508 or formed integrally with the face joint members 508. Wall panels 506 are positioned between face joint members 508. An excavation for installing the counterforts 504, face joint members 508 and/or wall panels 506 may be backfilled with soil or other fill material, imposing pressure on the counterforts 504 and on the back (soil-facing) surfaces of the wall panels 506. In one embodiment, backfill material may be tire derived aggregate made from shredded scrap tires. Using tire derived aggregate as back fill may reduce pressure on wall panels 506, and may mitigate seismic loads or other vibration of the wall components. In another embodiment, backfill material may be soil, gravel, or the like.

Although soil pressure on the wall panels 506 tends to push the wall out away from the soil, the counterforts 504 provide pullout resistance. In some embodiments, counterforts 504, face joint members 508 and/or wall panels 506 may be made of prestressed concrete, post-tensioned concrete, or the like. Counterfort walls are more fully described in U.S. Pat. No. 10,087,598 to John Babcock for "Counterfort retaining wall," which is incorporated herein by reference in its entirety.

In the depicted embodiment, two walls 500 are facing substantially opposite directions. For example, where an embankment is built to support a road or railway (e.g., using cut and fill construction to provide a consistent grade), the embankment may be supported at both sides of the road or railway by retaining walls facing away from the roads. Thus, counterforts 504 for both walls extend toward each other into the embankment or fill from the wall face.

In the depicted embodiment, pullout resistance is increased by coupling counterforts 504 together for the opposite facing walls 500. In one embodiment, a coupler 502 such as a threadbar with anchorages in both counterforts 504 may couple counterforts together.

Figure 6:
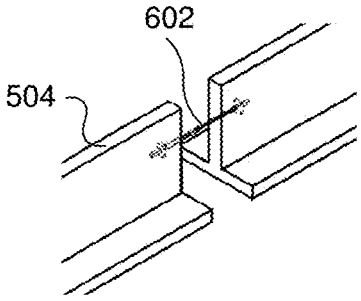
FIG. 6 is a perspective view illustrating one embodiment of a counterfort coupler.

FIG. 6 depicts one embodiment of a counterfort coupler 602, which may be substantially similar to the counterfort coupler 502 described above. In the depicted embodiment, both counterforts 504 include a threadbar anchorage and a threadbar extending out of the concrete from the threadbar anchorage. The threadbars are joined by a coupler 602, which may be threaded to engage both threadbars.

Figure 7:
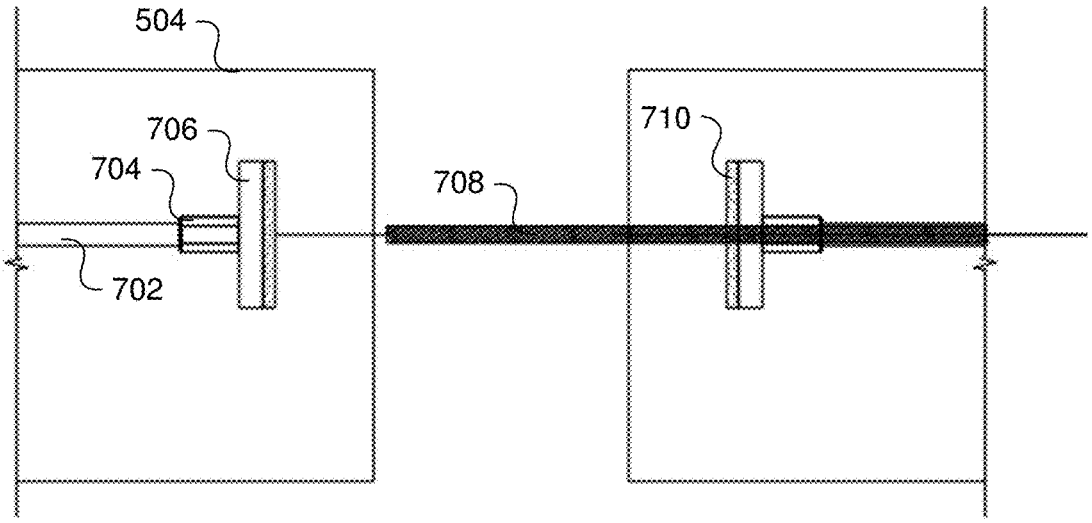
FIG. 7 is a cross section view illustrating another embodiment of a counterfort coupler.
Figure 8:
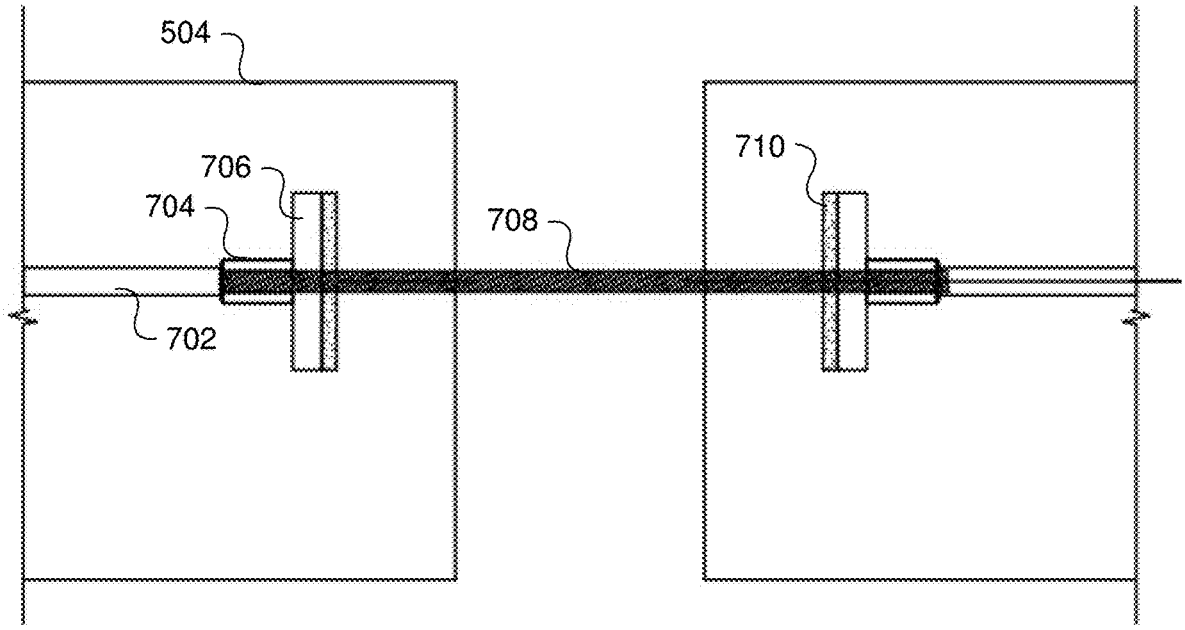
FIG. 8 is a cross section view further illustrating the counterfort coupler of FIG. 7.

FIGS. 7 and 8 depict another embodiment of a counterfort coupler, in a cross section view through the counterforts 504 so that components internal to the counterforts 504 are visible. In the depicted embodiment, the counterforts 504 include a bearing plate 706, a threadbar nut 704, and an elastomeric material 710 (which may be substantially similar to other elastomeric materials described above). One or more of the counterforts 504 may include a void 702. Ducts or sleeves (not shown) may allow a threadbar 708 to move relative to the concrete counterforts 504 to engage the threadbar nuts 704. In FIG. 7, a threadbar 708 is threaded into one of the counterforts 504, beyond the threadbar nut 704 and into a void 702. In FIG. 8, the threadbar is torqued to move out of the void 702 and into another counterfort 504 to engage another threadbar nut 704. With the threadbar 708 engaging both threadbar nuts 704, soil pressure on either or both retaining walls may result in tension in the threadbar 708, and in compression of the elastomeric material 710.

Figure 9:
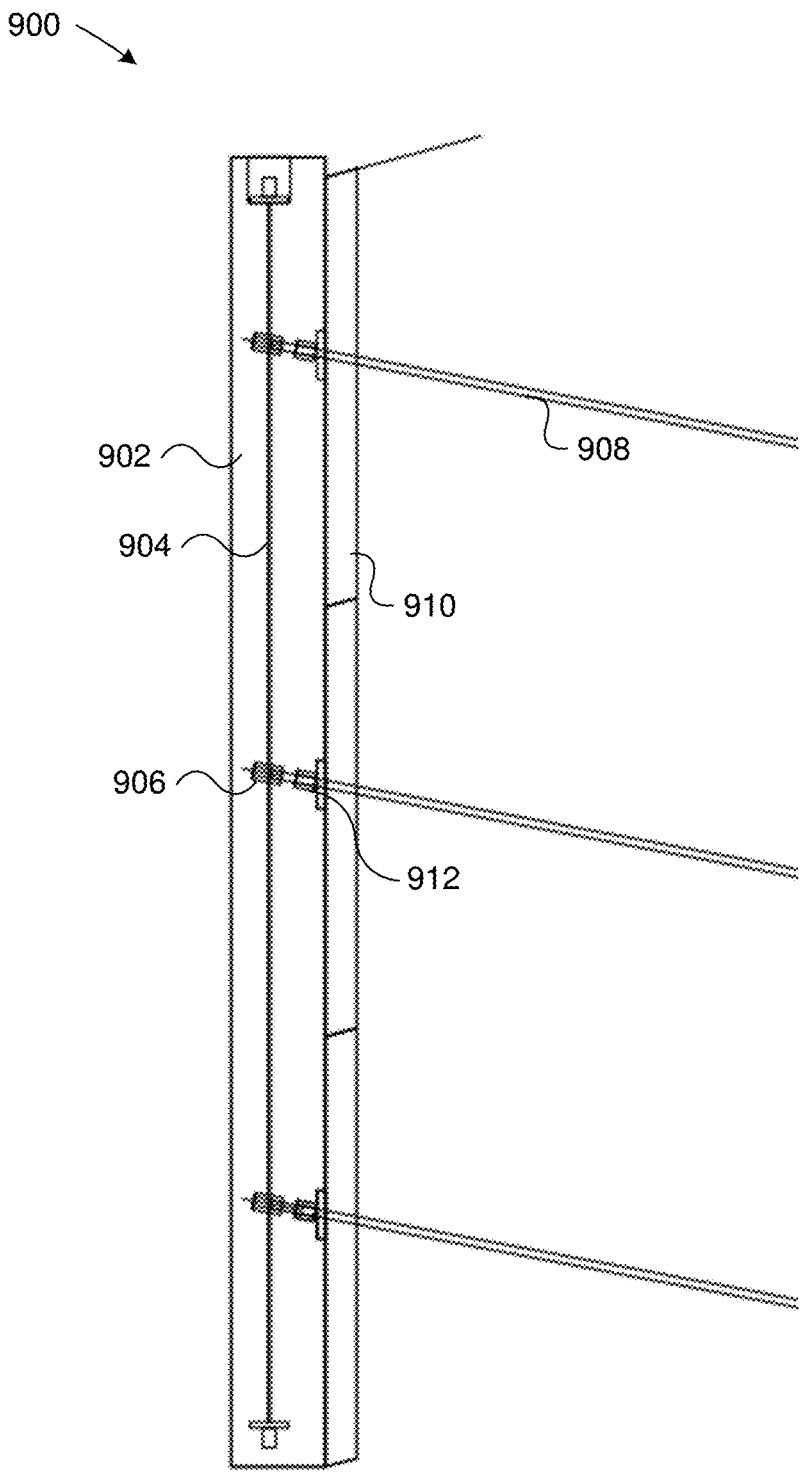
FIG. 9 is a side view illustrating one embodiment of a retaining wall.

FIG. 9 is a side view illustrating one embodiment of a retaining wall 900. In the depicted embodiment, the wall is anchored into a slope such as a hillside, embankment, or the like, by wall anchors 908, which may be threadbar, strand, tiebacks, soil nails, or the like. Sprayed concrete 910 (e.g., shotcrete) is applied, with nut and plate anchorages 912 coupling the sprayed concrete 910 to the anchors 908. Nuts of the nut and plate anchorages 912 may be torqued to a predetermined torque value to anchor the sprayed concrete 910. A sprayed concrete wall, however, may have portions that are under tension, resulting in cracking. For example, soil pressure on the back of the sprayed concrete 910 may cause tension on the front surface of the concrete. A stronger compressed (e.g., prestressed or post-tensioned) concrete wall face 902 may therefore be coupled to the sprayed concrete 910. Compression of the concrete wall face 902 may be induced by tension in strand 904 (e.g., multi-wire steel strand). Couplers 906 may couple the strand 904 to the anchors 908. The concrete wall face 902 may be cast in place, allowing the couplers 906 to be coupled to the strand 904 and the anchors 908 prior to casting of the concrete wall face 902.

Figure 10:
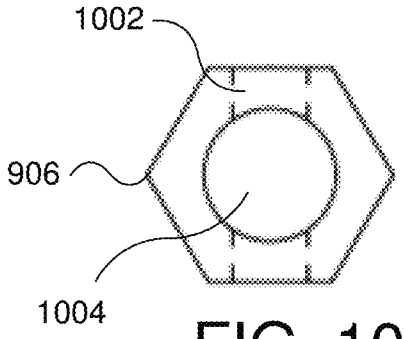
FIG. 10 is an end view illustrating one embodiment of a coupler for a retaining wall.
Figure 11:
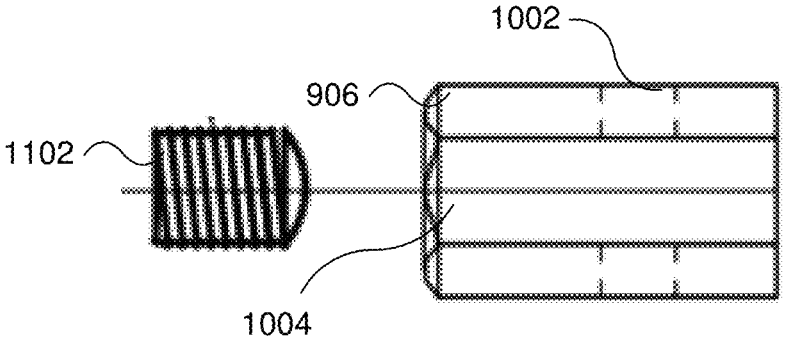
FIG. 11 is a side view further illustrating the coupler of FIG. 10.

FIGS. 10 and 11 further illustrate the couplers 906 of FIG. 9. FIG. 10 depicts a coupler 906 in an end view, and FIG. 11 depicts a side view. In the depicted embodiment, a coupler 906 may be hexagonal with a longitudinal opening 1004 to admit a threadbar (e.g., for an anchor 908). A transverse opening 1002 is provided to admit the strand 904. The strand 904 extends fully through the transverse opening 1002 of the coupler 906, within the concrete wall face 902. The anchor 908 may not extend fully through the longitudinal opening 1004 of a coupler 906, but may extend partially through the longitudinal opening 1004 from one end of the coupler 906, to approximately the depth of the strand 904. A stop nut 1102 may engage the other end of the longitudinal opening 1004, and may be torqued beyond contact with the strand 904, to prevent sliding of the coupler 906 along the strand 904.

The coupler 906 may be assembled with the strand 904 and an anchor 908 before the concrete wall face 902 is cast. To assemble the coupler 906 with the strand 904 and an anchor 908, the longitudinal opening 1004 at one end of the coupler 906 may be placed onto the exposed portion of the anchor 908 (e.g., threadbar) extending outward from the nut and plate 912, so that the anchor 908 extends partially into the coupler 906. Strand 904 may then be inserted through the transverse opening 1002 of the coupler 906. The stop nut 1102 may then be inserted into the other end of the longitudinal opening 1004 (e.g., the end that does not have the anchor 908 in it), and may be torqued. With multiple couplers 906 assembled in this manner to couple strand 904 to anchors 908, the concrete wall face 902 may then be cast.

Figure 12:
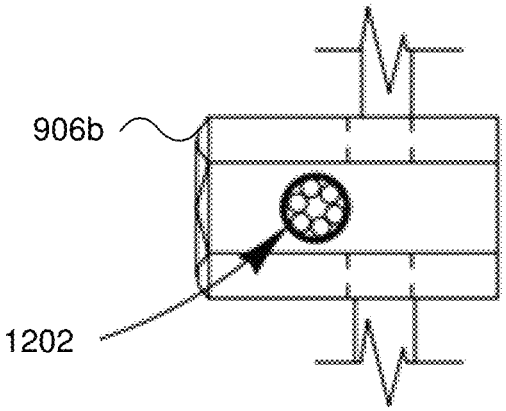
FIG. 12 is a side view illustrating another embodiment of a coupler.

FIG. 12 depicts a further embodiment of a coupler 906*b*, which may be substantially similar to the coupler 906 described above, including a longitudinal opening 1004 and a transverse opening 1002. In the depicted embodiment, the coupler 906*b* includes a second transverse opening 1202, perpendicular to the transverse opening 1002. Such a coupler may be used when a concrete wall face 902 includes vertical and horizontal strand, to couple both the vertical and horizontal strand to the anchor 908.

Figure 13:
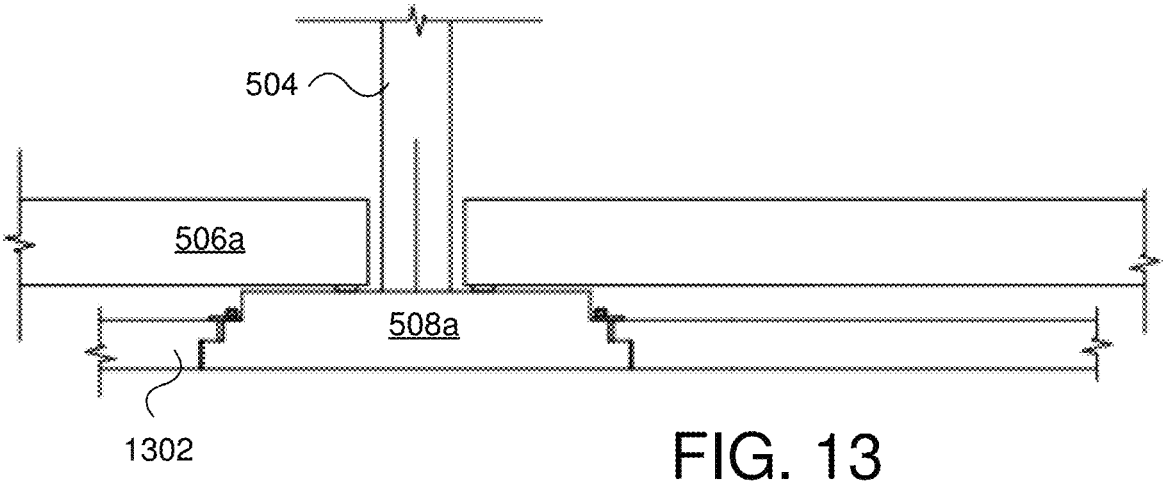
FIG. 13 is a top view illustrating one embodiment of a retaining wall with fascia panels.
Figure 14:
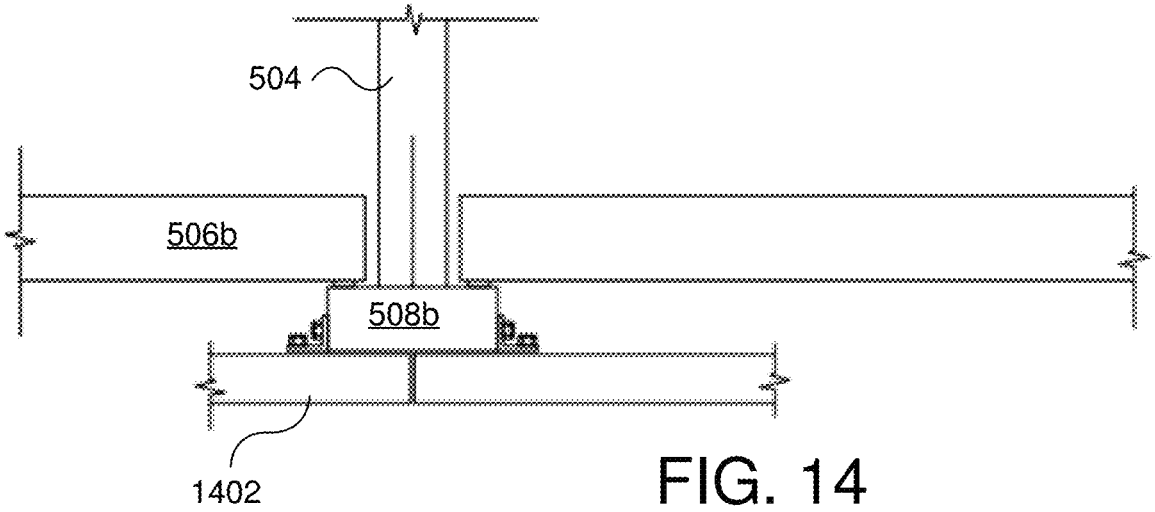
FIG. 14 is a top view illustrating another embodiment of a retaining wall with fascia panels.
Figure 15:
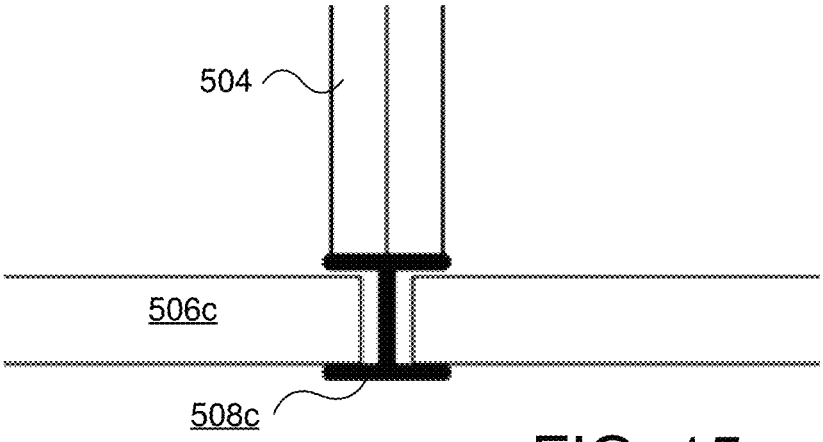
FIG. 15 is a top view illustrating another embodiment of a retaining wall.

FIGS. 13-15 depict top views of further embodiments of counterfort retaining walls. In the depicted embodiments, counterforts 504, face joint members 508*a-c*, and wall panels 506*a-c*, may be substantially similar to the counterforts 504, face joint members 508, and wall panels 506 described above with reference to FIG. 5. Referring to FIG. 5, wall panels 506 may be installed behind face joint members 508, thus producing a wall with an uneven front surface, where the face joint members 508 protrude forward several inches from the wall panels 506. In some walls, a smoother surface may be desired. For example, where a wall faces a highway, a smoother surface may mitigate damage from auto accidents where cars hit the wall, while a protrusion of several inches may result in greater damage. Thus, in various embodiments, walls may be configured to provide a substantially flush surface. A flush surface may have a texture applied, but may be free of protrusions that are significantly larger than the texture.

In FIGS. 13 and 14, the wall panels 506*a-b* are substantially similar to the wall panels 506 of FIG. 5, and fascia panels 1302, 1402 are coupled to the face joint members 508*a-b* in front of the wall panels 506*b*. In FIG. 13, the fascia panels 1302 include stepped edges that mate with stepped sides of the face joint member 508. In FIG. 14, the fascia panels 1402 are coupled to the face joint member 508*b* by angle brackets. In some embodiments, the use of angle brackets rather than stepped edges may simplify precasting of the fascia panels 1402 and face joint members 508*b*. Fascia panels 1302, 1402 may be concrete panels, but may be thinner or lighter than the wall panels 506*a-b* that bear the pressure of the retained soil.

In FIG. 15, the wall panels 506*c* are used without fascia panels. Instead, the face joint member 508*c* is a steel I-beam, with wall panels 506*c* engaging pockets on either side of the I-beam. As depicted in FIG. 15, the face joint member 508*c* may still protrude from the face of the wall, but only by the thickness of the steel, rather than be several inches for a concrete face joint member 508.

Figure 16:
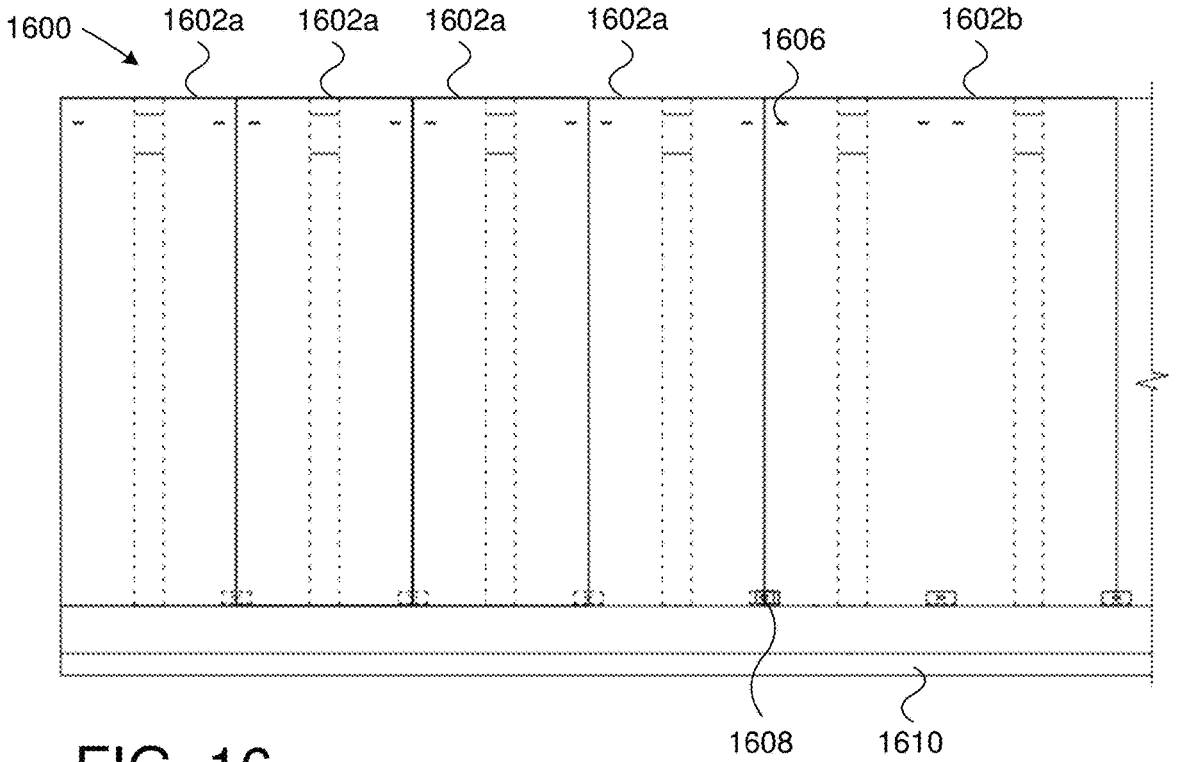
FIG. 16 is a front view illustrating certain components 1600 of a retaining wall, in one embodiment.
Figure 17:
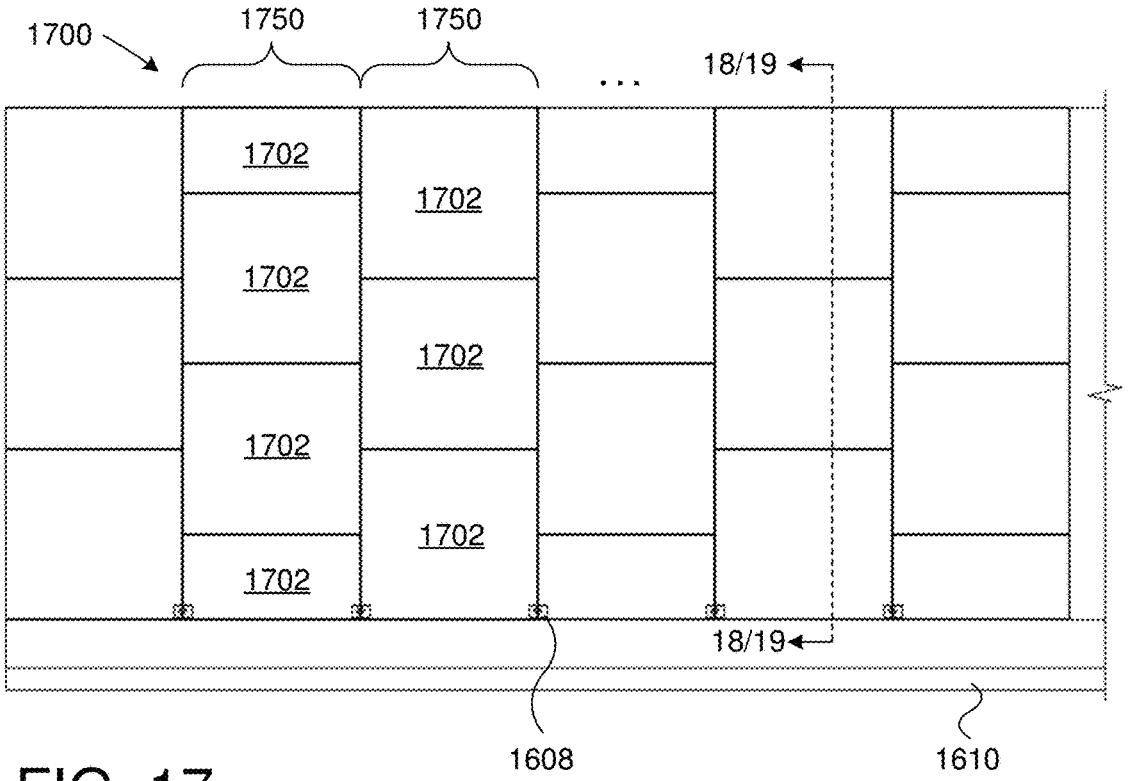
FIG. 17 is a front view illustrating one embodiment of a retaining wall.
Figure 18:
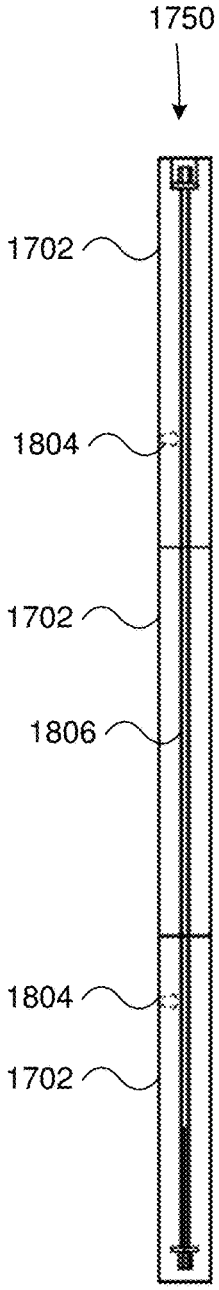
FIG. 18 is a cross section view illustrating one embodiment of a fascia panel assembly.
Figure 19:
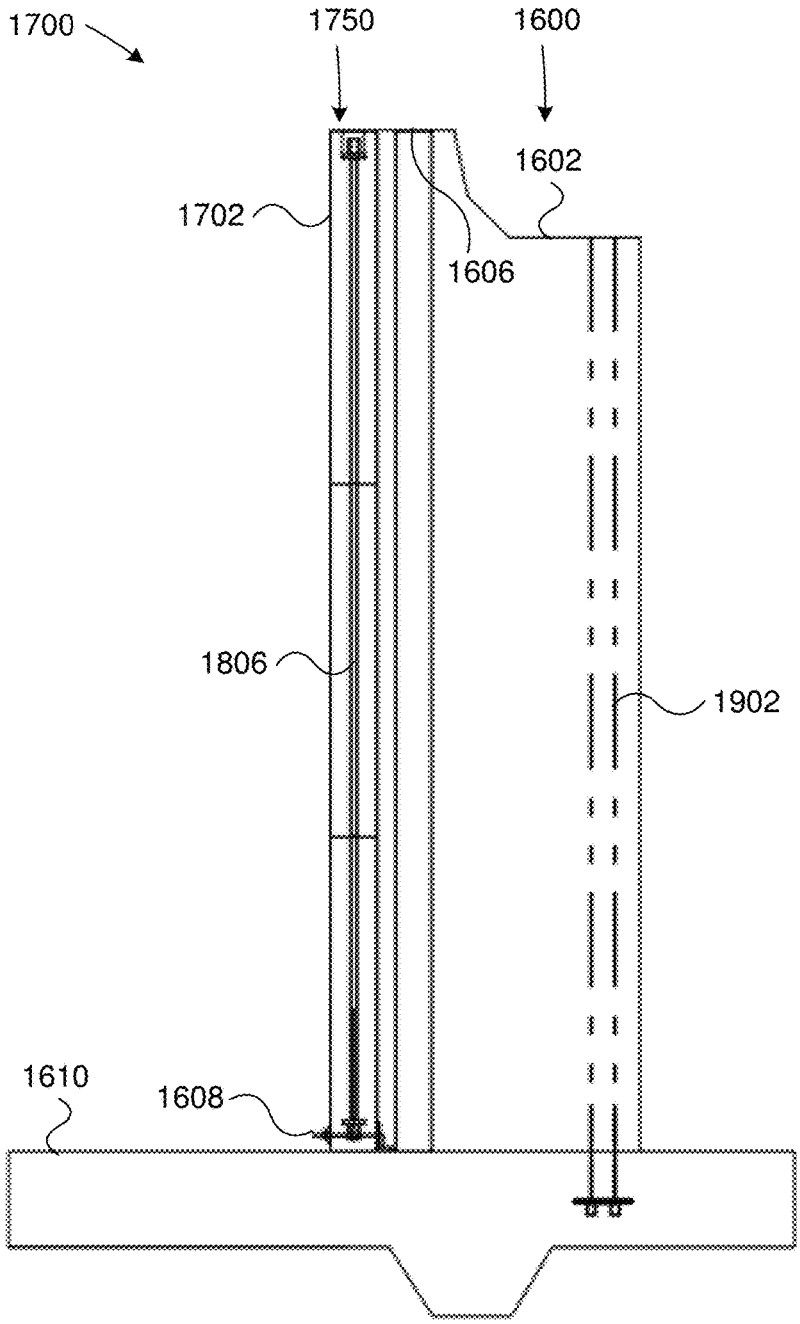
FIG. 19 is a side view illustrating one embodiment of a retaining wall with fascia panels.

FIG. 16 depicts certain components 1600 of a retaining wall, in a front view. As depicted in FIGS. 17 and 19, one embodiment of a retaining wall with fascia panels may include the components 1600 depicted in FIG. 16 and one or more fascia panel assemblies 1750 as depicted in FIGS. 17 and 18. In the depicted embodiment, the wall components 1600 include a footing 1610 and a plurality of vertical members 1602. The footing 1610, in one embodiment, may be made of concrete, including cast-in-place concrete, precast concrete, or the like.

Vertical members 1602, in various embodiments, may be precast concrete members assembled with the footing 1610 to form the load-bearing structure of the wall. In various embodiments, the vertical members 1602 may include single-tee members 1602*a* (with a "T" shaped cross section) or double-tee members 1602*b* (with a "TT" shaped cross section). In either case, the crossbar of the "T" or double "T" may be referred to as a flange, and the stem(s) of the "T" or double "T" may be referred to as a web. Thus, a single-tee member 1602*a* has a flange and one stem, while a double-tee member 1602*b* has a flange and two stems. Flanges are shown facing the viewer in FIG. 16, with stems extending away from the viewer on the back side of the wall, as indicated by dashed lines.

In the depicted embodiment, vertical single-tee and/or double-tee members 1602 are joined in a retaining wall with flanges forming a face of the wall (to which fascia panels may be attached), and with stem or web portions extending towards the embankment, backfill, or other soil that the wall retains. In certain embodiments, the vertical members 1602 may be prestressed concrete, post-tensioned concrete, or the like, and may include steel components as described herein (e.g., including multi-wire strand and/or threadbar) for compressing the concrete and/or for joining the concrete vertical members 1602 to the concrete footing 1610.

In some embodiments, stems of vertical members 1602 may be coupled to counterforts in a counterfort retaining wall as described above. In another embodiment, another type of retaining wall without counterforts may include vertical members 1602 coupled to a footing 1610.

In the depicted embodiment, the components 1600 of the retaining wall include upper connectors 1606 and lower connectors 1608 for coupling fascia panel assemblies (not shown in FIG. 16) to the footing 1610 and/or the vertical members 1602. In some embodiments, the connectors 1606, 1608 may be metal brackets, nut and bolt connectors, or the like, and may include plates, brackets or other components cast into or connected to the concrete to engage nuts, bolts, or other fasteners. In various embodiments, fascia panels may be assembled into multiple-panel fascia panel assemblies and coupled to a wall as described below. In other embodiments, additional connectors may be included between the upper connectors 1606 and the lower connectors 1608. The upper and lower connectors 1606, 1608 may be higher or lower than depicted.

FIG. 17 depicts one embodiment of a retaining wall 1700. In the depicted embodiment, the retaining wall 1700 includes the components 1600 described above with reference to FIG. 16, and includes fascia panels 1702 disposed in front of the vertical members 1602. The fascia panels are assembled into larger fascia panel assemblies 1750, and the fascia panel assemblies 1750 are coupled to the vertical members 1602 and/or the footing 1610 via upper connectors 1606 (not visible in FIG. 17) and lower connectors 1608. Cross sections of a fascia panel assembly 1750 and of the wall 1700, taken along the dashed line in FIG. 17, are shown in FIGS. 18 and 19, and are described in further detail below.

FIG. 18 depicts one embodiment of a fascia panel assembly 1750, in a cross section view. In the depicted embodiment, the fascia panel assembly 1750 includes a plurality of fascia panels 1702 and a steel component 1806 such as threadbar or multi-wire strand.

Fascia panels 1702, in various embodiments, may be concrete panels. In further embodiments, fascia panels 1702 may be precast concrete panels, and may have a size, shape, or exterior finish to match fascia panels of another type of retaining wall. For example, in one embodiment, a mechanically stabilized earth (MSE) retaining wall may include fascia panels, and the fascia panels 1702 of another retaining wall may be cast to match the appearance of the fascia panels for the MSE wall.

A plurality of fascia panels 1702 may be precast with a duct or sleeve to accommodate a steel component 1806 such as threadbar or multi-wire strand. Multiple fascia panels 1702 may be assembled in a panel assembly, and joined together via a steel component 1806. For example, in the depicted embodiment, an assembly of three fascia panels 1702 is coupled together via a steel component 1806. The steel component 1806 (e.g., strand or threadbar) may be post-tensioned to compress and strengthen the assembly of fascia panels 1702.

A plurality of fascia panels 1702 may be joined together in a post-tensioned panel assembly prior to being coupled to other components 1600 of a retaining wall 1700. The panels 1702 may then be lifted into place as an assembly, and coupled to a footing 1610 and/or vertical members 1602 via upper and lower connectors 1606, 1608. In some embodiments, one or more of the fascia panels 1702 may be cast with lifting points 1804, which may be voids or inserts cast into the fascia panels 1702 to facilitate lifting the fascia panel assembly 1750 into place.

In some embodiments, post-tensioned fascia panel assemblies 1750 may be installed more quickly than individual fascia panels 1702. For example, in the depicted embodiment, the fascia panels 1702 may be assembled and post-tensioned on the ground prior to lifting the fascia panel assembly 1750 into place and coupling the fascia panel assembly 1750 to the footing 1610 and/or vertical members 1602.

FIG. 19 depicts a cross section view of the retaining wall 1700 of FIG. 17. In the depicted embodiment, the wall 1700 includes the components 1600 described above with reference to FIG. 16, including a footing 1610 and vertical members 1602, and includes a fascia panel assembly 1750 as described above with reference to FIG. 17, including fascia panels 1702 and a steel component 1806 such as threadbar or multi-wire strand.

In the depicted embodiment, the stems of the vertical members 1602 are compressed (e.g., prestressed or post-tensioned) by steel components 1902 such as multi-wire strand or threadbar. Steel components 1902 may also couple the vertical members 1602 to the footing 1610.

As described above with reference to FIG. 17, fascia panels 1702 may be assembled in a panel assembly 1750 and joined together by a steel component 1806 such as threadbar or multi-wire strand. The fascia panel assembly 1750 may then be coupled to the other components 1600 of the wall at upper connectors 1606 and lower connectors 1608. For example, fascia panels 1702 may be assembled into panel assemblies 1750 at the site where the wall 1700 is built or at a precast plant where the fascia panels 1702 are made. The resulting panel assemblies 1750 may then be lifted into place, and coupled to the upper connectors 1606 and lower connectors 1608.

In another embodiment, however, a vertical steel component 1806 for compressing panels 1702 in a panel assembly 1750 (e.g., by post-tensioning of the steel component 1806) may be anchored in or to the footing 1610, and fascia panels 1702 with ducts or sleeves for admitting the steel component 1806 may be individually positioned by sliding the ducts or sleeves onto the top end of the steel component 1806. The steel component 1806 may then be post-tensioned to compress a group of fascia panels 1702 in a panel assembly 1750, and the panels 1702 may be coupled to the upper connectors 1606 and lower connectors 1608.

Although the wall 1700 is depicted as including fascia panel assemblies 1750 coupled to vertical members 1602 such as single-tee or double-tee members, other embodiments of retaining walls may include similar fascia panel assemblies 1750 coupled to shotcrete walls, counterfort walls, or the like.

Figure 20:
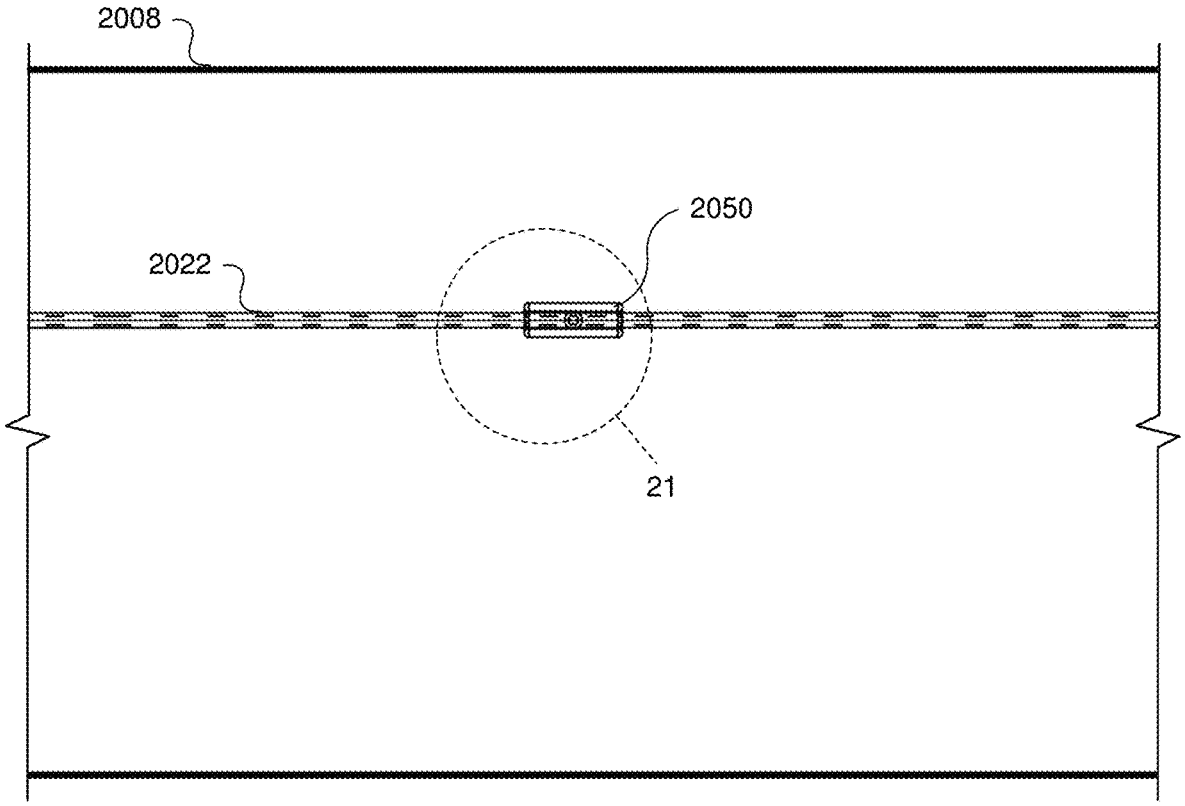
FIG. 20 is a cross section view illustrating post-tensioned strand in a concrete member.

FIG. 20 depicts post-tensioned strand 2022 in a concrete member 2008, in one embodiment. A dashed circle indicates a region that is enlarged in FIG. 21. The strand 2022 may be multi-wire strand, and the concrete member 2008 may be any component of a concrete structure. The strand 2022 and the concrete member 2008 may be substantially similar to the strand 122 and the concrete member 108 described above with reference to FIG. 1. As described above, strand 2022 may be subject to stressing loss, so that the compressive force applied to the concrete member 2008 by the strand 2022 is less than the tension initially applied to the strand 2022. In some embodiments, a strand-to-threadbar coupler 112 as described above with reference to FIGS. 1-4 may permit strand 122 to be re-tensioned via a threadbar 106. In the depicted embodiment, however, the strand 2022 may be re-tensioned via an apparatus 2050 for post-tensioning strand 2022.

Figure 21:
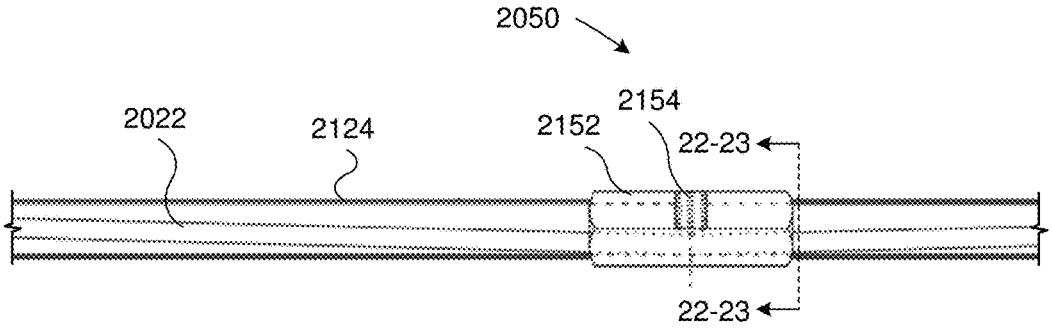
FIG. 21 is a side view illustrating one embodiment of an apparatus for post-tensioning strand.

In the depicted embodiment, the apparatus 2050 is disposed around a portion of the strand 2022. For example, an apparatus 2050 may be threaded onto the strand 2022 and/or a strand sleeve (e.g., sleeve 2124 as depicted in FIG. 21) prior to casting the concrete member 2008, or may be clamped around the strand. A threaded opening in the apparatus 2050 admits a stop nut. Tightening the stop nut deflects the strand 2022 within the apparatus 2050. The deflection of the strand 2022 causes elongation and increased tension in the strand 2022. An access void may be cast into the concrete member 2008 permitting a person to torque the stop nut after the concrete member 2008 has been cast and seating loss has occurred in the strand. Thus, in various embodiments, re-tensioning strand 2022 using an apparatus 2050 may compensate for stressing loss by increasing tension in the strand 2022.

FIG. 21 depicts one embodiment of an apparatus 2050 for post-tensioning strand, in a side view. In the depicted embodiment, the strand 2022 is sleeved strand, surrounded by a sleeve 2124. The sleeve 2124, in various embodiments, may be an oversized sleeve, with an interior diameter greater than the diameter of the strand 2022, thus permitting deflection of the strand 2022 within the sleeve 2124. In the depicted embodiment, the apparatus 2050 includes a body 2152 with a longitudinal opening for surrounding the strand 2022 and the sleeve 2124. The strand 2022 and the sleeve 2124 may be inserted through the longitudinal opening in the body 2152 prior to casting the concrete member 2008 or tensioning the strand 2022 between anchorages (not shown).

In some embodiments, the body 2152 may be glued, clamped, tack welded, or otherwise affixed to the sleeve 2124 prior to casting the concrete member 2008, to prevent longitudinal movement of the body 2152 along the sleeve 2124 until post-tensioning. In another embodiment, the body 2152 may be integral to the sleeve 2124. For example, a sleeve 2124 may include a portion with a threaded transverse opening for admitting a stop nut 2154, where the portion with the threaded transverse opening functions as the body 2152 of the apparatus 2050. Such a portion, in some embodiments may be reinforced or made of stronger material than the rest of the sleeve 2124. In other embodiments, the body 2152 is butted up against two sections of sleeve 2124. In the embodiment, the body 2152 may be connected to the two sections of sleeve 2124. One of skill in the art will recognize other ways to include a body 2152 with a sleeve 2124.

The body 2152 includes a threaded transverse opening for admitting the stop nut 2154. In the depicted embodiment, the stop nut 2154 has been torqued into the body 2152 beyond the point of initial contact between the stop nut 2154 and the strand 2022. The stop nut 2154 in the depicted position pushes the strand 2022 to the side of the sleeve 2124. The resulting deflection of the strand 2022 within the sleeve 2124 increases the path length between strand anchorages, thus increasing tension in the strand 2022. Although the apparatus 2050 in the depicted embodiment increases tension in the strand 2022 by causing deflection of the strand within the sleeve 2124, an apparatus 2050 in another embodiment may be used with bare or unsleeved strand 2022, and the apparatus 2050 may be formed with a region for the strand deflection to take place in. For example, an apparatus 2050 may include end openings that admit bare strand 2022 and an internal space larger than the end openings, so that deflection of the strand 2022 takes place along a length of the strand 2022 that runs from a first end opening, to a point of maximum deflection within the internal space, and back to a second end opening. Alternatively, an apparatus 2050 may include a side opening permitting deflection of the strand outside the body of the apparatus 2050, on a path from a first end opening, through the side opening and back, to a second end opening. Rotated cross sections of the apparatus 2050, taken along the dashed line in FIG. 21, are shown in FIGS. 22-23, and are described in further detail below.

Figure 22:
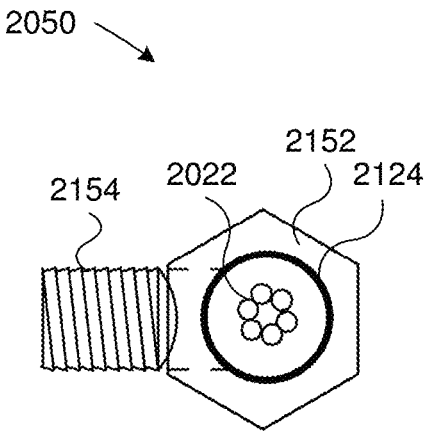
FIG. 22 is an end view illustrating a further embodiment of an apparatus for post-tensioning strand, prior to post-tensioning.
Figure 23:
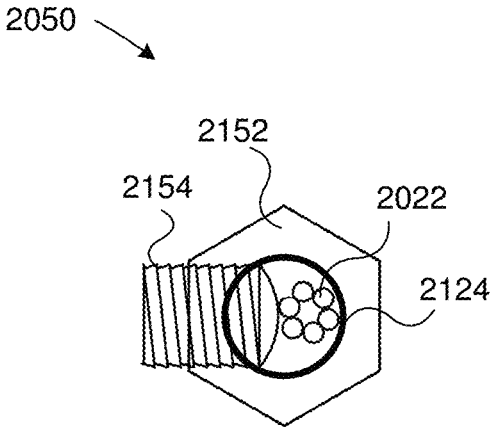
FIG. 23 is an end view further illustrating the apparatus of FIG. 21, after post-tensioning.

FIGS. 22 and 23 depict further embodiments of an apparatus 2050 for post-tensioning strand 2022. As described above, the apparatus 2050 may be used to re-tension strand 2022 that was initially tensioned (e.g., between anchorages), but that is subject to stressing loss. The apparatus 2050 is depicted prior to post-tensioning or re-tensioning in FIG. 22, and after post-tensioning or re-tensioning in FIG. 23. In the depicted embodiment, the apparatus 2050 includes a body 2152 with a longitudinal opening for surrounding the strand 2022 and the sleeve 2124. The diameter of the sleeve 2124 may be greater than the diameter of the strand 2022 to permit deflection of the strand 2022. The body 2152 includes a threaded transverse opening for admitting the stop nut 2154. In FIG. 22, prior to post-tensioning or re-tensioning, the stop nut 2154 is not engaged to the point that it causes deflection of the strand 2022. In FIG. 23, after post-tensioning, the stop nut 2154 has been torqued beyond the point of initial contact with the strand 2022, thus deflecting the strand 2022 within the sleeve 2124. Torquing the stop nut 2154 beyond its initial contact with the strand 2022 may increase tension in the strand 2022 by causing deflection.

Figure 24:
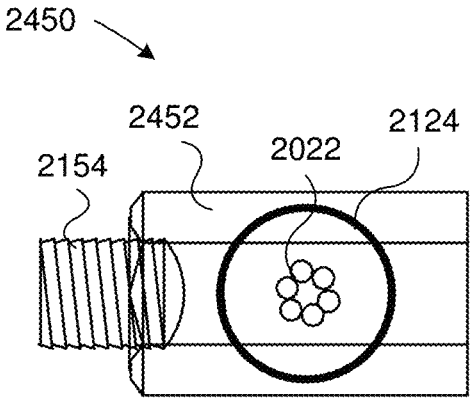
FIG. 24 is a side view illustrating another embodiment of an apparatus for post-tensioning strand, prior to post-tensioning.
Figure 25:
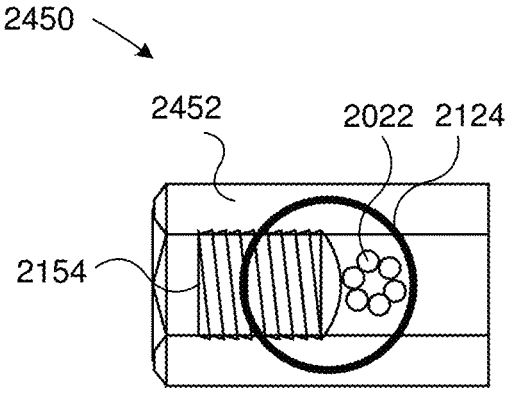
FIG. 25 is a side view further illustrating the apparatus of FIG. 23, after post-tensioning.

FIGS. 24 and 25 depict another embodiment of an apparatus 2450 for post-tensioning strand 2022. The apparatus 2450 is depicted prior to post-tensioning or re-tensioning in FIG. 24, and after re-tensioning in FIG. 25. In FIGS. 24 and 25, the apparatus 2450 is depicted in a cross section view similar to the cross section view of the apparatus 2050 in FIGS. 22 and 23, with the cross section similarly taken across a multi-wire strand 2022 and depicting a view along the strand 2022. In the depicted embodiment, the apparatus 2450 for post-tensioning strand 2022 is substantially similar to the apparatus 2050 described above with reference to FIGS. 20-23, including a body 2452 substantially similar to the body 2152 described above, except that the body 2452 includes a transverse opening that admits the strand 2022 and the sleeve 2124, and a longitudinal opening that is threaded for admitting a stop nut 2154. The strand 2022 and the sleeve 2124 may be threaded through the transverse opening prior to tensioning the strand 2022 between anchorages and/or casting the surrounding concrete. In FIG. 24, prior to post-tensioning, the stop nut 2154 is not engaged to the point that it causes deflection of the strand 2022. In FIG. 25, after post-tensioning, the stop nut 2154 has been torqued beyond the point of initial contact with the strand 2022, thus deflecting the strand 2022 within the sleeve 2124. Torquing the stop nut 2154 beyond its initial contact with the strand 2022 may increase tension in the strand 2022 by causing deflection.

Figure 26:
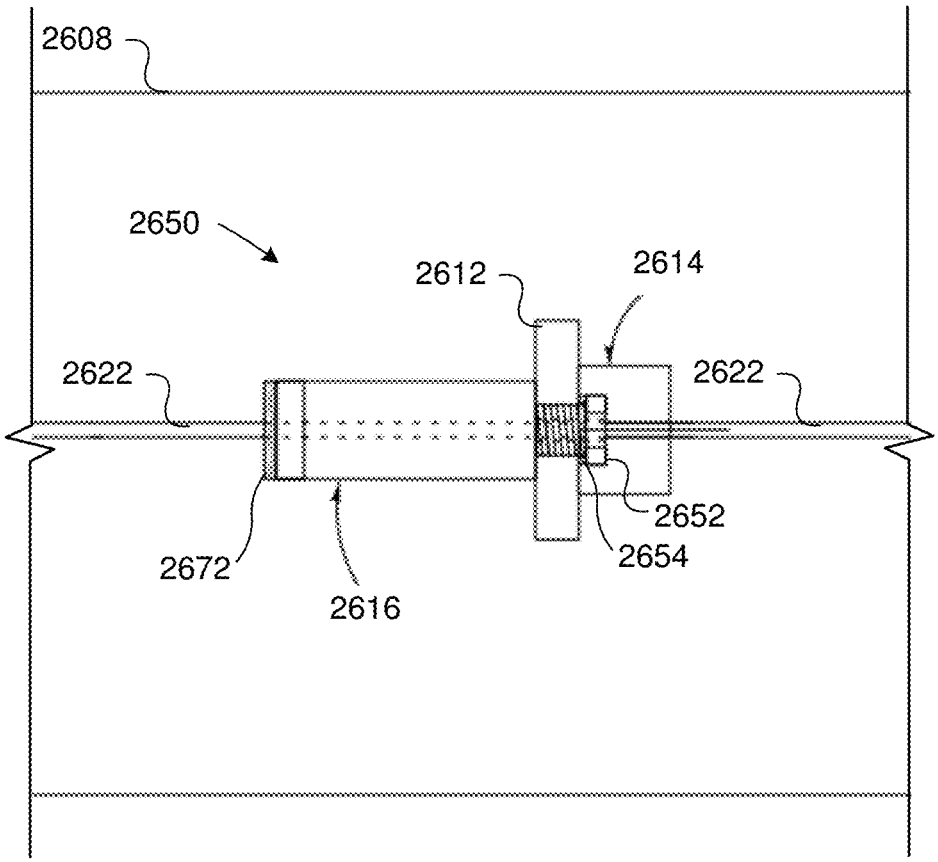
FIG. 26 is a cross section view illustrating post-tensioned strand in a concrete member.

FIG. 26 depicts another embodiment of post-tensioned strand 2622 in a concrete member 2608. The strand 2622 may be multi-wire strand, and the concrete member 2608 may be any component of a concrete structure. The strand 2622 and the concrete member 2608 may be substantially similar to the strand 122 and the concrete member 108 described above with reference to FIG. 1. Although the strand 2622 is not depicted as sleeved strand 26 in FIG. 26, the strand 2622 in some embodiments may be partially or fully covered by a sleeve, a duct, or a spiral wrap, or may be otherwise partially or fully unbonded to the surrounding concrete as described above with reference to FIGS. 1-3. As described above, strand 2622 may be initially tensioned between anchorages with an initial tension sufficient to engage jaws of a strand chuck 2616, but may be subject to stressing loss, so that the compressive force applied to the concrete member 2608 by the strand 2622 is less than the tension initially applied to the strand 2622. In the depicted embodiment, the strand 2622 may be re-tensioned via an apparatus 2650 for post-tensioning strand 2622.

In the depicted embodiment, the apparatus 2650 for post-tensioning strand 2622 includes a steel plate 2612, a strand chuck 2616, and a screw 2652. The strand chuck 2616 may be substantially similar to the strand chuck 116 described above with reference to FIG. 1, and is coupled to the strand 2622. In the depicted embodiment, the apparatus 2650 further includes a compressible material 2672 disposed at an end of the strand chuck 2616. The compressible material 2672 may be substantially similar to the compressible material 372 described above with reference to FIG. 3. The steel plate 2612 includes a threaded opening. The steel plate 2612 is coupled to or embedded in the concrete member 2608.

The screw 2652 includes a longitudinal opening, and the strand 2622 extends through the longitudinal opening in the screw 2652. The screw 2652 engages the threaded opening in the steel plate 2612 to contact the strand chuck 2616. The length of the screw 2652 is greater than the thickness of the plate 2612, so that torquing the screw 2652 beyond the point of initial contact with the strand chuck 2616 pushes the strand chuck 2616 away from the plate 2612, compressing the compressible material 2672. With the plate 2612 anchored in the concrete member 2608 and the chuck 2616 coupled to the strand 2622, pushing the strand chuck 2616 away from the plate 2612 elongates the strand 2622 between the strand chuck 2616 and a strand anchorage, thus re-tensioning the strand. For example, with reference to FIG. 26, the strand may be tensioned between the strand chuck 2616 and a strand anchorage (not shown) in the concrete member, to the right of the depicted portions of the concrete member 2608.

In the depicted embodiment, an access void 2614 is cast or blocked into the concrete member 2608 providing access to torque the screw 2652 after the concrete member 2608 has been cast and seating loss has occurred in the strand 2622. Thus, in various embodiments, re-tensioning strand 2622 using an apparatus 2650 may compensate for stressing loss by increasing tension in the strand 2622.

In the depicted embodiment, the apparatus 2650 further includes a flexible ring 2654. The flexible ring 2654 may be a rubber or elastomeric sealant ring that separates the head of the screw 2652 from the plate 2612 when the screw 2652 is torqued to the point of initial contact with the strand chuck 2616. The flexible ring 2654 may deform as additional torque is applied to the screw 2652 to push the strand chuck 2616 away from the plate 2612. In some embodiments, the flexible ring 2654 may be omitted, but the screw 2652 and the plate 2612 may similarly be assembled or configured so that the head of the screw 2652 is separated from the plate 2612 when the screw 2652 is torqued to the point of initial contact with the strand chuck 2616, allowing additional torque to be applied to the screw 2652 to push the strand chuck 2616 away from the plate 2612.

Figure 27:
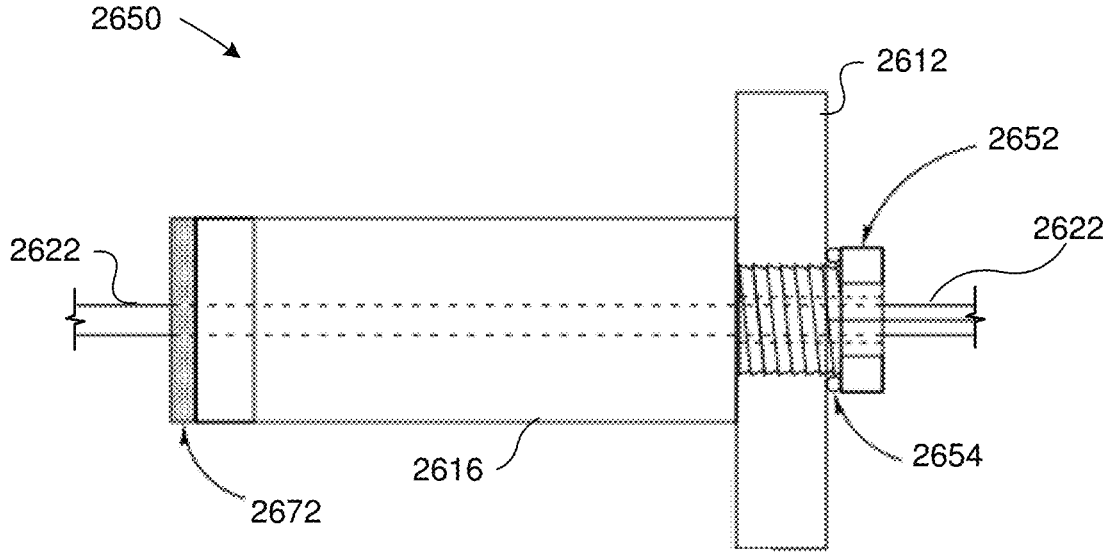
FIG. 27 is a side view illustrating one embodiment of an apparatus for post-tensioning strand.
Figure 28:
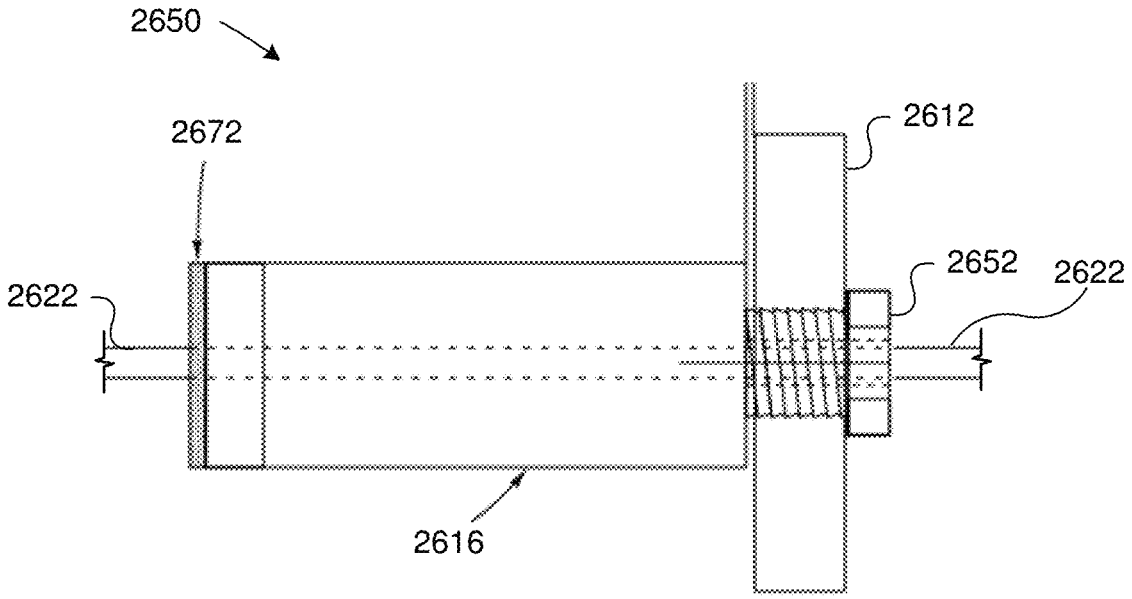
FIG. 28 is a side view further illustrating one embodiment of an apparatus for post-tensioning strand.

FIGS. 27 and 28 depict further embodiments of an apparatus 2650 for post-tensioning strand 2622. In the depicted embodiments, the apparatus 2650 includes a strand chuck 2616, a plate 2612, a screw 2652, and a flexible ring 2654, and a compressible material 2672 substantially as described above.

FIG. 27 depicts the apparatus 2650 with the screw 2652 torqued to the point of initial contact with the strand chuck 2616. The strand chuck 2616 is in contact with the plate 2612. Tension in the strand 2622 may hold the strand chuck 2616 against the plate 2612. The flexible ring 2654 and the compressible material 2672 are uncompressed.

In FIG. 28, the screw 2652 is torqued beyond the point of initial contact with the strand chuck 2616. The flexible ring 2654 (not visible) and the compressible material 2672 are compressed, and the end of the screw 2652 pushes the strand chuck 2616 away from the plate 2612, leaving a gap between the strand chuck 2616 and the plate 2612. As described above with reference to FIGS. 1-3, components that move relative to the concrete, such as the strand chuck 2616 may be coated in a release agent, covered by a sleeve, or otherwise kept unbonded from the surrounding concrete to facilitate motion of the strand chuck 2616 and elongation of the strand 2622. The strand 2622 is elongated by a distance corresponding to the length of the gap between the strand chuck 2616 and the plate 2612, resulting in increased tension in the strand 2622.

Figure 29:
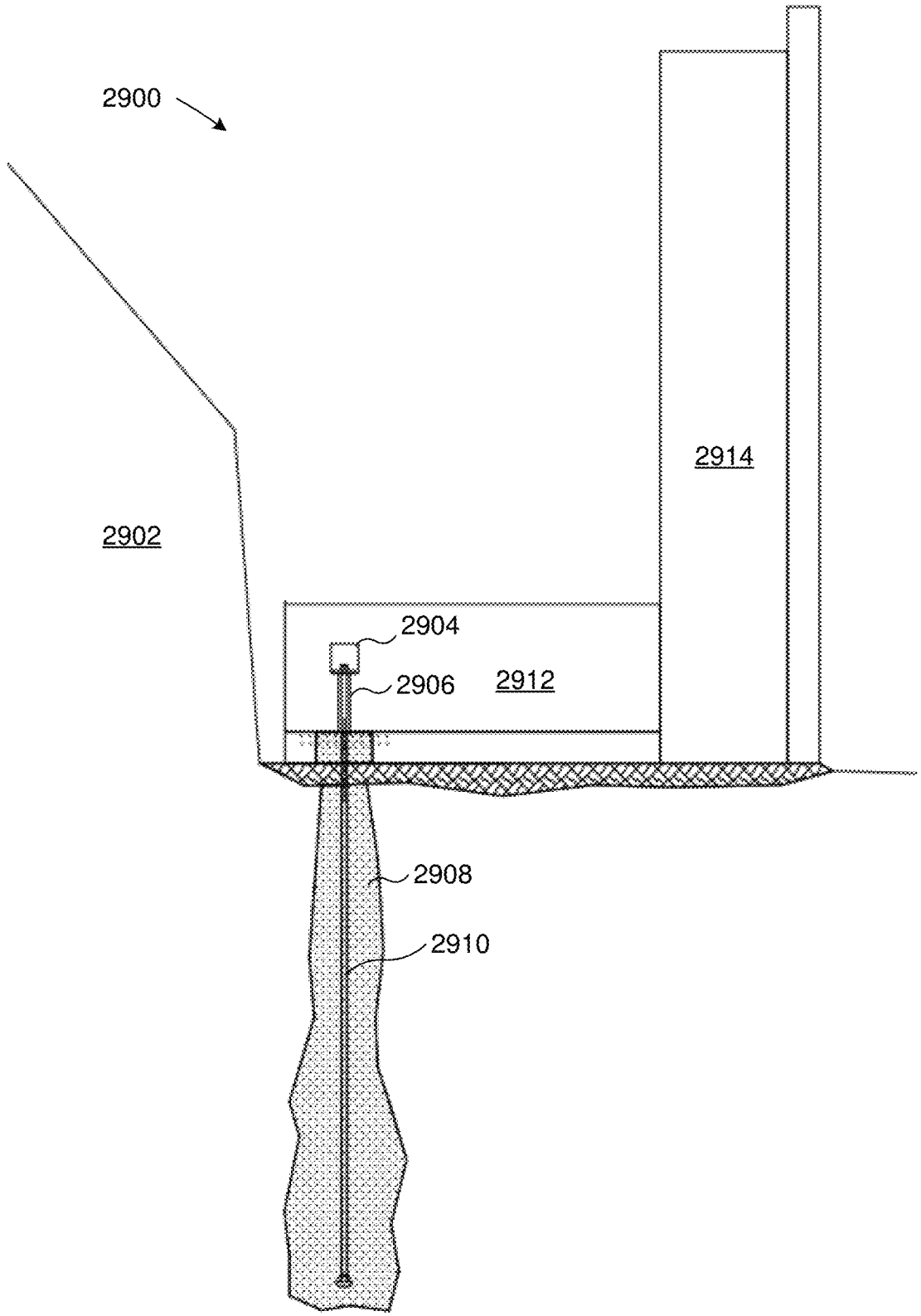
FIG. 29 is a side view illustrating one embodiment of a counterfort retaining wall.
Figure 30:
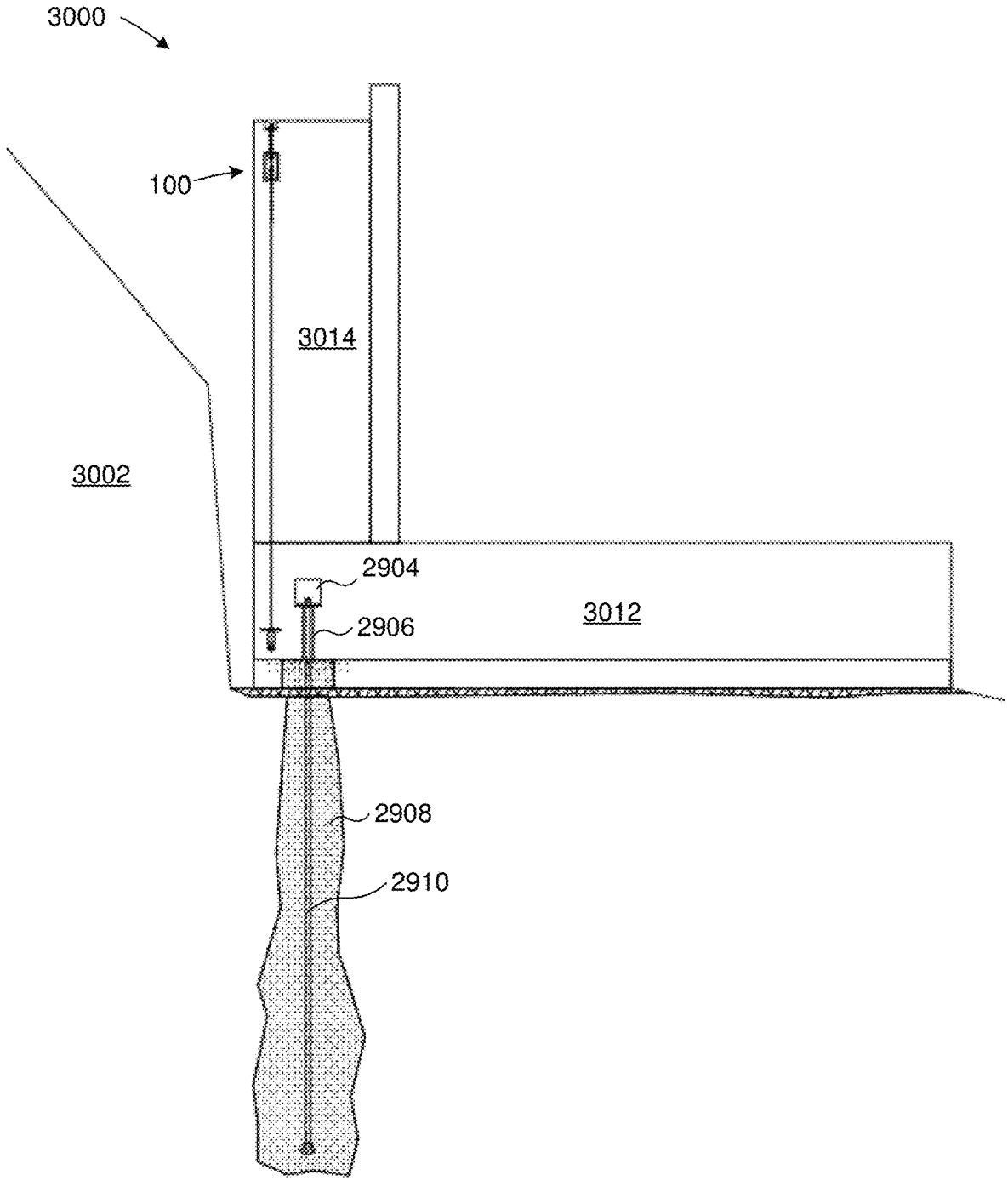
FIG. 30 is a side view illustrating one embodiment of a reverse counterfort retaining wall.

FIGS. 29 and 30 depict embodiments of counterfort retaining walls 2900, 3000. The walls are depicted in a side view, with some of the components depicted in cross section for clarity in depicting internal steel components. In general, as described above with reference to FIG. 5, counterforts 2912, 3012 may anchor a wall in soil, and may be coupled to face joint members 2914, 3014. Wall panels (not shown in FIGS. 29 and 30 for clarity in depicting other components of walls 2900, 3000) may be positioned between face joint members 2914, 3014, and the back side of the wall may be backfilled with soil or other fill material, imposing pressure on the on the back (soil-facing) surfaces of the wall panels so that the wall panels are pressed against the face joint members. 2914, 3014. In the embodiments of retaining walls 2900, 3000 depicted in FIGS. 29 and 30, counterforts 2912, 3012 are coupled to vertical soil nails 2910.

Referring to FIG. 29, one embodiment of a counterfort wall 2900 is shown, in a cross section of a slot cut into a hillside 2902 or embankment. A counterfort 2912 may be installed in a slot cut in a hillside 2902. The space above the counterfort 2912, between the rear edge of the slot cut and the face joint member 2914, may be backfilled with soil or other material. Thus, the fill material may impose vertical pressure on the counterfort 2912 and impose lateral pressure that presses wall panels against the face joint member 2914.

In the depicted embodiment, the counterfort 2912 is coupled to a vertical soil nail 2910. In one embodiment, a soil nail 2910 is a hollow steel component that is driven vertically into the soil, and jet-grouted by high-pressure injection of grout into the hollow steel component, so that the soil nail 2910 is surrounded by a column of grout 2908. In another embodiment, a soil nail 2910 may be solid steel, but may be similarly surrounded by a column of grout 2908. The combination of the steel soil nail 2910 and the surrounding column of grout 2908 may be similar to other steel-reinforced concrete columns. In fact, although a soil nail 2910 is included in the depicted embodiment, a counterfort 2912 may be coupled to another vertical foundation component such as a cast-in-drilled-hole concrete pile, a precast concrete pile, or the like.

In various embodiments, a soil nail 2910 (or another foundation component such as a column including steel such as threadbar or multi-wire strand) may be installed with a portion of the steel 2910 extending above the level of the surrounding grout 2908 or concrete. The exposed steel portion may be coupled to another concrete component, such as a counterfort 2912, and post-tensioned to couple the counterfort 2912 to the foundation component. Although exposed steel of a soil nail 2910 is described herein for coupling a counterfort 2912 to the soil nail 2910, a component other than a counterfort 2912 may similarly be coupled to exposed steel of a soil nail 2910 in another embodiment. For example, soil nails 2910 may be used as support for above-ground concrete columns or pillars, as support for building foundations, or the like, and the components above the soil nails 2910 may be coupled to the soil nails 2910 in a manner similar to the coupling of the counterfort 2912 to the soil nail 2910 as disclosed herein.

The counterfort 2912, in the depicted embodiment, is precast concrete, and is cast with a duct 2906 or tube to admit the exposed steel of the soil nail 2910. The counterfort 2912 also includes an access void 2904 at the top of the duct 2906 or tube, providing access for a threadbar nut or similar fastener to be torqued onto the end of the exposed steel of the soil nail 2910. After the soil nail 2910 is installed in the soil, the counterfort 2912 may be lowered into place so that the duct 2906 is placed onto the exposed steel of the soil nail 2910. A nut may then be placed in the access void 2904 and torqued onto the exposed steel, thus coupling the horizontal counterfort 2912 to the vertical soil nail 2910.

Referring to FIG. 30, another embodiment of a counterfort wall 3000 is depicted. In the depicted embodiment, the counterfort wall 3000 includes soil nails 2910, counterforts 3012, face joint members 3014 and wall panels (not shown), which may be substantially as described above with reference to FIG. 29 but with the counterforts 3102 as reverse counterforts, as described below.

In the depicted embodiment, the counterfort wall 3000 is a reverse counterfort wall, where a counterfort 3012 coupled to a face joint member 3014 extends from the face joint member 3014 in a direction away from an existing slope 3002, such as a hillside or embankment, rather than towards the existing slope 3002. Reverse counterfort walls 3000 may be used in situations where it is not practical to make cuts in the slope 3002 to insert counterforts. For example, if a lower road or railroad is to be built adjacent to an existing, higher road or railroad, with the retaining wall 3000 retaining the soil under the higher road or railroad, making slot cuts in the existing slope 3002 would involve closure of the existing road or railroad at significant expense or with significant disruption to users of the existing road or railroad. Thus, instead of cutting into the slope 3002 to install counterforts, reverse counterforts 3012 may be used that extend away from the slope 3002.

As described above with reference to FIG. 29, the space between the slope 3002 and the face joint member 3014 may be backfilled with soil or other material, imposing lateral pressure wall panels against the face joint member 3014. Unlike in FIG. 29, backfill behind the wall panels is not directly above the counterfort 3012, and does not directly impose downward pressure on the counterfort 3012. Instead, outward lateral pressure on the wall panels is transferred to the face joint member 3014, and the resulting torque on the wall is one of the causes of downward force on the counterfort 3012. The region directly above the reverse counterfort 3012 may be also be filled with soil or other fill material so that the counterfort 3012 is covered (e.g., with the soil in front of the wall 3000 at a lower height than the soil behind the wall 3000, allowing another structure such as a road to be built above the counterfort 3012.

In the depicted embodiment, the reverse counterfort 3012 is coupled to a soil nail 2910 as described above with reference to FIG. 29. The soil nail 2910 is installed and grout 2908 is pressure-injected. A portion of the soil nail 2910 remains exposed above the grout 2908. The counterfort 3012 includes a duct 2906 and an access void 2904 allowing the counterfort 3012 to be lowered onto the exposed steel of the soil nail 2910 and post-tensioned to the soil nail 2910. Additionally, in the depicted embodiment, the face joint member 3014 is coupled to the counterfort 3012 using a system 100 as described above with reference to FIG. 1, including a strand-to-threadbar coupler that allows re-tensioning of the strand to compensate for stressing loss.

Referring to both FIG. 29 and FIG. 30, various embodiments of walls 2900, 3000 that include both vertical soil nails 2910 and horizontal counterforts (e.g., counterforts 2912 or reverse counterforts 3012) may transfer the load on the wall to vertical and horizontal component, providing increased pullout resistance and stability compared to an otherwise equivalently-configured wall that omits either the counterforts or the vertical soil nails. Alternatively, in some embodiments, a wall with vertical soil nails and horizontal counterforts may use shorter counterforts and/or shorter soil nails to provide equivalent pullout resistance and stability to a wall with longer counterforts and no soil nails, or to a wall with longer soil nails and no counterforts.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system comprising:

a concrete member;

one or more multi-wire strands disposed within the concrete member;

a strand-to-threadbar coupler block disposed within a void in the concrete member, the strand-to-threadbar coupler block formed with a threadbar opening to admit a threadbar, and with one or more strand openings; and one or more strand chucks coupled to the strand-to-threadbar coupler block at the one or more strand openings, wherein a chuck diameter for the one or more strand chucks is greater than a diameter for the one or more strand openings, and wherein the one or more multi-wire strands extend through the one or more strand openings and engage the one or more strand chucks, and wherein the void is configured to allow movement of the strand-to-threadbar coupler block in a direction to tension the multi-wire strand in response to a force applied by a threadbar extending through the threadbar opening.

2. The system of claim 1, further comprising:

a threadbar anchorage, wherein the threadbar extends from the threadbar opening through the concrete member in a direction opposite to the one or more multi-wire strands to the threadbar anchorage; and a threadbar nut coupling the threadbar to the strand-to-threadbar coupler block such that tensioning the threadbar against the concrete member displaces the strand-to-threadbar coupler block and increases tension on the one or more multi-wire strands.

3. The system of claim 2, wherein:

the threadbar nut is affixed to the strand-to-threadbar coupler block; and the threadbar anchorage includes a second threadbar nut for tensioning the threadbar against the concrete member.

4. The system of claim 2, further comprising a void in the concrete member positioned to permit access to the threadbar nut for tensioning the threadbar.

5. The system of claim 2, further comprising a second concrete member, wherein the threadbar anchorage is affixed to the second concrete member such that the threadbar couples the concrete member to the second concrete member.

6. The system of claim 1, further comprising a strand covering that covers at least a portion of the one or more multi-wire strands, proximate to the strand-to-threadbar coupler block, such that the portion of the one or more multi-wire strands proximate to the strand-to-threadbar coupler block is unbonded to the concrete member.

7. The system of claim 1, wherein:

the strand-to-threadbar coupler block is disposed in a void within the concrete member;

the void is larger than the strand-to-threadbar coupler block; and the void permits movement of the strand-to-threadbar coupler block in a direction that increases tension on the one or more multi-wire strands.

8. The system of claim 1, further comprising a compressible material disposed on one side of the strand-to-threadbar coupler block, such that movement of the strand-to-threadbar coupler block in a direction that compresses the compressible material and increases tension on the one or more multi-wire strands.

9. The system of claim 1, wherein the strand-to-threadbar coupler block is coated in a release agent that prevents bonding of the strand-to-threadbar coupler block to the concrete member.

10. The system of claim 1, wherein:

the strand-to-threadbar coupler block comprises a first plate coupled to a second plate disposed across a central void from the first plate;

the first plate is coupled to the one or more strand chucks; and the second plate comprises the threadbar opening.

11. The system of claim 1, wherein:

the strand-to-threadbar coupler block comprises a plate with a central portion and a peripheral portion;

the threadbar opening is formed in the central portion; and the one or more strand chucks are coupled to the peripheral portion.

12. A system comprising:

a first concrete member;

a second concrete member;

one or more multi-wire strands disposed within the first concrete member;

a strand-to-threadbar coupler block disposed within the first concrete member, the strand-to-threadbar coupler block formed with a threadbar opening to admit a threadbar, and with one or more strand openings;

one or more strand chucks coupled to the strand-to-threadbar coupler block at the one or more strand openings, wherein a chuck diameter for the one or more strand chucks is greater than a diameter for the one or more strand openings, and wherein the one or more multi-wire strands extend through the one or more strand openings and engage the one or more strand chucks;

a threadbar anchorage affixed to the second concrete member, wherein the threadbar extends from the threadbar opening in a direction opposite to the one or more multi-wire strands to the threadbar anchorage and wherein the threadbar couples the first concrete member to the second concrete member; and a threadbar nut coupling the threadbar to the strand-to-threadbar coupler block such that tensioning the threadbar displaces the strand-to-threadbar coupler block within a void in the concrete member and increases tension on the one or more multi-wire strands, wherein the void is shaped to allow displacement of the strand-to-threadbar coupler block.

13. The system of claim 12, wherein:

the threadbar nut is affixed to the strand-to-threadbar coupler block; and the threadbar anchorage includes a second threadbar nut for tensioning the threadbar.

14. The system of claim 12, further comprising a void in the first concrete member positioned to permit access to the threadbar nut for tensioning the threadbar.

15. The system of claim 12, further comprising a strand covering that covers at least a portion of the one or more multi-wire strands, proximate to the strand-to-threadbar coupler block, such that the portion of the one or more multi-wire strands proximate to the strand-to-threadbar coupler block is unbonded to the first concrete member.

16. The system of claim 12, wherein:

the void is larger than the strand-to-threadbar coupler block; and the void permits movement of the strand-to-threadbar coupler block in a direction that increases tension on the one or more multi-wire strands.

17. The system of claim 12, further comprising a compressible material disposed on one side of the strand-to-threadbar coupler block, such that movement of the strand-to-threadbar coupler block in a direction that compresses the compressible material and increases tension on the one or more multi-wire strands.

18. The system of claim 12, wherein:

the strand-to-threadbar coupler block comprises a first plate coupled to a second plate disposed across a central void from the first plate;

the first plate is coupled to the one or more strand chucks; and the second plate comprises the threadbar opening.

19. The system of claim 12, wherein the first concrete member comprises a counterfort and the second concrete member comprises a retaining wall and wherein the counterfort extends into a hillside behind the retaining wall.

20. A system comprising:

a first concrete member;

a second concrete member;

one or more multi-wire strands disposed within the first concrete member;

a strand-to-threadbar coupler block disposed within the first concrete member, the strand-to-threadbar coupler block formed with a threadbar opening to admit a threadbar, and with one or more strand openings;

one or more strand chucks coupled to the strand-to-threadbar coupler block at the one or more strand openings, wherein a chuck diameter for the one or more strand chucks is greater than a diameter for the one or more strand openings, and wherein the one or more multi-wire strands extend through the one or more strand openings and engage the one or more strand chucks;

a threadbar anchorage affixed to the second concrete member, wherein the threadbar extends from the threadbar opening in a direction opposite to the one or more multi-wire strands to the threadbar anchorage and wherein the threadbar couples the first concrete member to the second concrete member;

a threadbar nut coupling the threadbar to the strand-to-threadbar coupler block such that tensioning the threadbar displaces the strand-to-threadbar coupler block and increases tension on the one or more multi-wire strands, wherein the threadbar nut is affixed to the strand-to-threadbar coupler block and wherein the threadbar anchorage includes a second threadbar nut for tensioning the threadbar;

a void in the concrete member positioned to permit access to the threadbar nut for tensioning the threadbar, wherein the void permits movement of the strand-to-threadbar coupler block in a direction that increases tension on the one or more multi-wire strands; and a strand covering that covers at least a portion of the one or more multi-wire strands, proximate to the strand-to-threadbar coupler block, such that the portion of the one or more multi-wire strands proximate to the strand-to-threadbar coupler block is unbonded to the first concrete member.

* * * * *